US010413143B2

(12) United States Patent
Van der Kooi et al.

(10) Patent No.: US 10,413,143 B2
(45) Date of Patent: Sep. 17, 2019

(54) CLEANING DEVICE HAVING A NOZZLE FOR CLEANING A SURFACE

(71) Applicant: KONINKLIJKE PHILIPS N.V., Eindhoven (NL)

(72) Inventors: Johannes Tseard Van der Kooi, Eindhoven (NL); Britt Roumen, Eindhoven (NL); Matthijs Hendrikus Lubbers, Eindhoven (NL); Ralph Pierre Krebbers, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/652,814

(22) PCT Filed: May 6, 2014

(86) PCT No.: PCT/EP2014/059163
§ 371 (c)(1),
(2) Date: Jun. 17, 2015

(87) PCT Pub. No.: WO2015/074769
PCT Pub. Date: May 28, 2015

(65) Prior Publication Data

US 2016/0256025 A1 Sep. 8, 2016

(30) Foreign Application Priority Data

Nov. 21, 2013 (EP) ..... 13193779

(51) Int. Cl.
*A47L 9/04* (2006.01)
*A47L 11/24* (2006.01)
*A47L 11/40* (2006.01)

(52) U.S. Cl.
CPC ..... *A47L 9/0477* (2013.01); *A47L 9/0488* (2013.01); *A47L 11/24* (2013.01); *A47L 11/4041* (2013.01);
(Continued)

(58) Field of Classification Search
CPC ..... A47L 11/33; A47L 9/0477; A47L 11/18; A47L 11/24; A47L 11/4044
See application file for complete search history.

(56) References Cited

U.S. PATENT DOCUMENTS 2,275,356 A * 3/1942 Funk ..... A47L 11/22 15/52.1
4,254,525 A 3/1981 Combest
(Continued)

FOREIGN PATENT DOCUMENTS

DE 19960995 A1 7/2001
EP 0265205 A2 4/1988
(Continued)

*Primary Examiner* — Bryan R Muller

(57) ABSTRACT

A nozzle arrangement including a brush provided with brush elements having tip portions for contacting a surface and picking up dirt and/or liquid during rotation of the brush about a brush axis, a driving mechanism for rotating the brush, a first deflector element with a first deflector surface that extends substantially parallel to the brush axis and that interacts with the brush during the rotation of the brush for releasing the picked-up dirt and/or the liquid particles, and a second deflector element that is spaced apart from the brush and the first deflector element, the second deflector element having a second deflector surface that is oriented at an angle to the first deflector surface, wherein the second deflector surface deflects the dirt and/or liquid particles, which are released from the brush at the first deflector surface, into an exhaust channel that begins between the first and second deflector elements.

13 Claims, 7 Drawing Sheets

(52) U.S. Cl.
CPC ..... *A47L 11/4044* (2013.01); *A47L 9/0411* (2013.01)

(56) References Cited

U.S. PATENT DOCUMENTS

| | | | | | |
|---|---|---|---|---|---|
| 4,813,092 | A * | 3/1989 | Tsuchiya | A47L 11/33 | 15/41.1 |
| 6,968,587 | B2 * | 11/2005 | Grey | A46B 13/001 | 15/377 |
| 7,334,284 | B2 * | 2/2008 | Grey | A47L 7/02 | 15/41.1 |
| 2013/0174371 | A1 * | 7/2013 | Jones | A47L 5/30 | 15/319 |
| 2014/0137351 | A1 | 5/2014 | Vollmer | | |

FOREIGN PATENT DOCUMENTS

| | | | | |
|---|---|---|---|---|
| JP | 5494758 | A | * | 7/1979 |
| JP | 5494758 | A | * | 7/1979 |
| JP | 2001238831 | A | | 9/2001 |
| JP | 2002369780 | A | | 12/2002 |
| JP | 2003033305 | A | | 2/2003 |
| JP | 2007000372 | A | * | 1/2007 |
| WO | 8404663 | A1 | | 12/1984 |
| WO | 2005074779 | A1 | | 8/2005 |
| WO | 2010041184 | A1 | | 4/2010 |
| WO | 2013050906 | A1 | | 4/2013 |

* cited by examiner

CLEANING DEVICE HAVING A NOZZLE FOR CLEANING A SURFACE

This application is the U.S. National Phase application under 35 U.S.C. § 371 of International Application No. PCT/EP2014/059163, filed on May 6, 2014, which claims the benefit of European Application No. 13193779.9 filed on Nov. 21, 2013. These applications are hereby incorporated by reference herein.

FIELD OF THE INVENTION

The present invention relates to a cleaning device for cleaning a surface. Further, the present invention relates to a nozzle arrangement for such a cleaning device.

BACKGROUND OF THE INVENTION

Hard floor cleaning these days is done by first vacuuming the floor, followed by mopping it. Vacuuming removes the coarse dirt, while mopping removes the stains. From the state of the art many appliances, especially targeting the professional cleaning sector, are known that claim to vacuum and mop in one go. Appliances for the professional cleaning sector are usually specialized for big areas and perfectly flat floors. They rely on hard brushes and suction power to get water and dirt from the floor. Appliances for home use often use a combination of a hard brush and a double-squeegee nozzle. Like the appliances for the professional sector these products use the brush to remove stains and the squeegee in combination with an under-pressure to lift the dirt from the floor.

Said squeegee elements are usually realized by a flexible rubber lip that is attached to the bottom of the cleaning device and merely glides over the surface to be cleaned, thereby pushing or wiping dirt particles and liquid across or off the surface to be cleaned. An under-pressure, usually generated by a vacuum aggregate, is used to ingest the collected dirt particles and liquid.

In current single rotating wet brush floor cleaning devices it is an issue that dirt particles are not picked up by the vacuum air flow but get launched across the floor. This leads to a disposal of the dirt across the floor but not to the actually intended cleaning of the floor. The problem is that by using rotating brushes the dirt particles are scattered within the housing in an unpredictable way. Especially at high rotation speeds of the brush the trajectory of the dirt particles bouncing forth and back between the brush and the interior of the housing is most of the time completely random and therefore unpredictable. In some floor cleaning devices of the prior art this problem is tried to be solved with large vacuum aggregates that provide a high suction power. However, it is evident that such large vacuum aggregates are not only cost-intensive, but also consume a lot of energy. Apart from that large vacuum aggregates are quite noisy.

Experiments of the applicant have shown that even if powerful vacuum aggregates are used, the problem of unintentionally dispersing the dirt with the brush over the floor may not be completely overcome. In most known cleaning devices according to the prior art the dirt particles are scattered within the interior of the nozzle in such an uncontrolled manner that not all dirt particles are directly guided into the nozzle outlet.

In case of cleaning devices with a single rotating brush this often results in the fact that the dirt particles that have been picked up by the brush will make a further turn with the brush, which throws them back onto the floor again. Especially when the exhaust is not able to catch (suck) the dirt particles away from the brush and into the nozzle outlet, the brush may take the dirt particles back to the floor again. As a result, the dirt particles may be shut out of the nozzle again and get dispersed over the floor. It is evident that this does not lead to a satisfactory cleaning result.

An exemplary device that uses a brush to disperse the dust in combination with an air flow created by a vacuum aggregate to lift the dispersed dust is known from WO 2005/074779 A1. This device includes a vacuum aggregate to create an under-pressure with a suction chamber that is delimited at its front and rear side by delimiting ends, such as runners. The rotary brush is arranged inside the suction chamber. The brush is used to sweep the floor and disperse the dust, which is then ingested by the vacuum source. The two delimiting elements that are proposed according to this solution are designed to be vertically mobile, so that they can be lifted depending on a forward or backward movement of the nozzle. These delimiting elements have the function to stabilize the under-pressure with the suction chamber in order to receive a constant suction flow (a constant under-pressure) within the suction chamber independent of the movement direction of the nozzle.

However, the device proposed in WO 2005/074779 A1 includes several disadvantages. First of all, the construction including the two delimiting elements is rather complicated and interference-prone. Secondly, the brush which is used in this vacuum cleaner is an agitator (also denoted as adjutator) with stiff brush hairs to agitate the carpet. An assembly including such an agitator requires a high suction power in order to receive a satisfactory cleaning result especially on hard floors. Therefore, large vacuum aggregates need to be used which again result in a high consumer price of the device. Apart from that, this device does also not solve the problem that the dirt particles are scattered in an uncontrollable manner and may get launched back to the floor. Similar as explained above it seems problematic to guide the dirt particles in a more or less controlled manner away from the brush and into the nozzle outlet.

EP 0 265 205 A2 discloses a floor cleaner in which driven rollers are integrally mounted with a pair of rotating cleaning bodies on the respective opposite end portions thereof, each of the rotating cleaning bodies being provided with a plurality of blades made of an elastic material on the outer circumference thereof. The wheels comprise pairs of main wheels disposed at forward and rear portions of the casing. The floor cleaner further comprises auxiliary wheels, each of which is located at an intermediate position defined between the respective driven rollers, and each of which is positioned somewhat lower than the respective main wheels.

WO 84/04663 discloses a machine for cleaning of preferably hard surfaces which machine has two against each other rotating brushes. The brushes throw through a gap between them dirt particles to a container. Between the brushes and the container runs a transport channel for the dirt particles and which channel is widening upwards. Means for supply of liquid detergent has permeable devices which forward liquid detergent to the brushes because of the rotation of the brushes.

JP 2003033305 discloses a sucking instrument for floors, which is capable of improving a cleaning function along walls without spoiling the function that the sucking instrument for floor originally has. The sucking instrument comprises a sucking instrument body, a front wall of which is formed with a bumper having a revolving brush provided near the bumper. The bumper is provided with a finny part consisting of an elastic body hanging down toward the floor surface to be cleaned, and the revolving brush is placed on a location where its revolution locus contacts with or is close to the finny part.

SUMMARY OF THE INVENTION

It is an object of the present invention to provide an improved cleaning device that shows, compared to the state of the art, an improved cleaning performance, has at the same time a nozzle of small size, is easy to use and less cost-intensive for the user. It is especially an object to provide a cleaning device in which the picked-up dirt particles are guided in a controlled manner towards the nozzle outlet (i.e. towards the inlet of the exhaust channel) in order to prevent the above-described effect of unintentionally dispersing the dirt particles over the floor without ingesting them. The invention is defined by the independent claims.

This object is achieved by a nozzle arrangement comprising:

- a brush rotatable about a brush axis, said brush being provided with brush elements having tip portions for contacting the surface to be cleaned and picking up dirt and/or liquid particles from the surface during the rotation of the brush,
- a drive means for rotating the brush,
- a first deflector element with a first deflector surface that extends substantially parallel to the brush axis, wherein the first deflector surface is configured to interact with the brush during the rotation of the brush for releasing the picked-up dirt and/or the liquid particles from the brush, and
- a second deflector element that is spaced apart from the brush and the first deflector element, the second deflector element comprising a second deflector surface that is oriented transverse to the first deflector surface, wherein the second deflector surface is configured to deflect the dirt and/or liquid particles, which are released from the brush at the first deflector surface, into an exhaust channel that begins between the first and second deflector elements.

The above-mentioned object is furthermore, according to a second aspect of the present invention, achieved by a cleaning device comprising the above-mentioned nozzle arrangement.

As is well-known from geometry, in a three-dimensional Euclidean space, a line and a plane that do not share a point are said to be parallel. From this general notion, it is clear what is meant by a first deflector surface that extends substantially parallel to the brush axis.

Preferred embodiments of the invention are defined in the dependent claims. It shall be understood that the claimed nozzle arrangement has similar and/or identical preferred embodiments as the claimed cleaning device and as defined in the dependent claims.

In order to overcome the above-mentioned problem of unintentionally dispersing the dirt and/or liquid particles across the floor instead of directly ingesting them, the inventors have found a new way to manipulate the behavior of the dirt and/or liquid particles within the nozzle housing. The new dirt manipulation configuration is provided within the nozzle of the cleaning device and comprises a first deflector element which is configured to interact with the brush during the rotation of the brush and a second deflector element that deflects the dirt and/or liquid particles that are released from the brush at the first deflector element towards an inlet of an exhaust channel. The herein presented nozzle exhaust solution guides the particles directly away from the brush into the inlet of the exhaust channel (into the nozzle outlet). It prevents that the dirt particles that have been picked up with the brush will make another turn with the brush and then shoots out of the nozzle again (without being ingested).

The idea behind the proposed dirt manipulation configuration is to provide deflector elements that serve as a guidance for the dirt particles in order to receive a more or less predictable behavior of the dirt particles within the nozzle housing. The trajectories that the dirt particles follow within the nozzle are better controllable and therefore easier to predict.

According to an embodiment, the first deflector surface contacts the tip portions of the brush during the rotation of the brush for releasing the picked-up dirt and/or the liquid particles from the brush. A contact between the first deflector surface and the tip portions of the brush is advantageous, however not mandatory. In order to achieve the above-mentioned more or less predictable behavior of the dirt particles, the first deflector surface may also be slightly spaced apart from the tip portions of the brush. The distance between the first deflector surface and the tip portions of the brush is, during the rotation of the brush, preferably smaller than 2 mm, even more preferably smaller than 1 mm. Said distance is given/limited by a normal size of the dirt particles. The distance should be anywhere in the range of a common dirt particle size in order to achieve the predictable behavior of the dirt particles, as will be explained further below. A too large distance between the first deflector surface and the tip portions of the brush could lead to a scattering effect, meaning that the dirt particles could be released at the interface between the brush and the first deflector surface in an unpredictable, chaotic way.

The behavior of the dirt particles at the interface between the brush and the surface to be cleaned (floor) is known. Experiments have shown that, depending on the dirt properties (size and weight), the dirt particles leave the brush with an angle of around 0-25° relative to the floor when the dirt is entering the brush along with the rotation of the brush. This means that the direction, with which the dirt and/or liquid particles are launched from the brush when the brush contacts the floor and collects the dirt and/or liquid particles, is predictable for the majority of particles. The reason why the dirt and/or liquid particles are launched from the brush at the brush-to-floor interface under the above-mentioned dirt release angle $\alpha$ of 0-25° is the following: When the brush elements come into contact with a dirt particle or a liquid particle, the brush elements are slightly bent. As soon as the brush elements with the dirt and/or liquid particles adhering thereto loose contact with the surface, the brush elements are straightened out again, wherein especially the tip portions of the brush elements are moved with a relatively high acceleration. As a result, the centrifugal acceleration at the tip portion of the brush elements is increased. Hence, the liquid droplets and the dirt particles adhering to the brush elements are launched from the brush elements, as the acceleration forces are higher than the adhesive forces. The values of the acceleration forces of course depend on various factors, including the deformation of the brush, the linear density of the brush elements, the speed at which the brush is driven, and also on the properties (weight and size) of the dirt and/or liquid particles.

Experiments have shown that in the cleaning device used according to the present invention the dirt release angle $\alpha$ ranges between 0-25° relative to the floor when the dirt is entering the brush along with the rotation of the brush.

Since the behavior of the dirt and/or liquid particles at the interface between the brush and the floor is known, this known dirt behavior is used also at the first deflector element that is provided according to the present invention. The first deflector element comprises a first deflector surface that extends substantially parallel to the brush axis and preferably contacts the tip portions of the brush during the rotation of the brush (very small distances are also possible between the first deflector element and the brush, as explained above). This first deflector element is arranged within the nozzle housing. It is preferably arranged at a side of the brush where the brush elements enter the nozzle arrangement during its rotation, i.e. after touching the surface to be cleaned (floor). Since the first deflector element touches the brush with the first deflector surface, the dirt particles behave more or less the same at the interface between the brush and the first deflector surface as at the interface between the brush and the floor.

The first deflector surface is thus used to generate the same dirt particle behavior that also occurs at the interface between the brush and the floor. As soon as the tip portions of the brush loose contact from the first deflector surface during the brush's rotation, the dirt and/or liquid particles will be released from the brush under a similar dirt release angle of 0-25°. Experiments have shown that the majority of dirt particles will be launched from the brush at an angle of 0° relative to the first deflector surface (parallel to the first deflector surface). Hence, the direction with which the dirt and/or liquid particles will be launched from the brush as soon as the brush elements loose contact with the first deflector surface is almost perfectly predictable.

By arranging a second deflector element transverse to the first deflector element and spaced apart from it, it is possible to further deflect the dirt and/or liquid particles that have been released from the brush at the first deflector surface towards the inlet of the exhaust channel. The position of the second deflector element is derived from the dirt release angle (the angle at which the dirt and/or liquid particles are released from the brush at the first deflector surface). In contrast to the first deflector element, the second deflector element does not touch the brush. The first and the second deflector element together define the dirt manipulation configuration that is used to guide the dirt and/or liquid particles away from the brush in a more or less predictable manner towards the exhaust channel. Dirt and/or liquid particles will therefore enter the nozzle arrangement due to the rotation of the brush. The dirt and/or liquid particles will then be released from the brush after contacting the first deflector surface and will be launched from the brush with the above-mentioned dirt release angle of 0-25°. After that, the dirt and/or liquid particles will hit the second deflector surface and will then be deflected from the second deflector surface towards the inlet of the exhaust channel.

The second deflector element is preferably arranged at or around the inlet of the exhaust channel, wherein the second deflector surface preferably faces towards the inlet of the exhaust channel. "Facing towards the exhaust channel" shall not mean that the second deflector surface directly has to face towards the inlet of the exhaust channel, but it should not face away from the inlet of the exhaust channel. It is especially advantageous if the normal vector of the second deflector surface points into the exhaust channel. In this way, the dirt and/or liquid particles, which are released from the brush at the first deflector surface and hit the second deflector surface afterwards, will be deflected more or less directly to the inlet of the exhaust channel and may then be ingested. By means of the first and the second deflector element, the dirt and/or liquid particles are in other words deflected similar as a billiard ball within the nozzle housing and thereby guided in a controllable manner towards the exhaust channel. It is to be noted that this is of course only a descriptive explanation of the technical principle that is used herein.

According to an embodiment of the present invention the second deflector surface is tilted relative to the first deflector surface, wherein the first deflector surface is during use of the cleaning device arranged perpendicular to the surface to be cleaned, and wherein a tilt angle $\gamma$ between the second deflector surface and the horizontal, which during use of the cleaning device is arranged parallel to the surface to be cleaned, is in a range of $5° < \gamma < 50°$, more preferably in a range of $10° < \gamma < 40°$, and most preferably equal to 30°.

It is to be noted that also other angles $\gamma$ are also possible as long as the angle $\gamma$ is not 0° and not 90°. This means that the first deflector surface shall not be arranged parallel and not be arranged exactly perpendicular to the first deflector surface. Otherwise the dirt and/or liquid particles, that are released from the brush at the first deflector surface, would not be able to hit the second deflector surface, i.e. they would not be deflected at the second deflector surface towards the inlet of the exhaust channel. A relative angle of 30° between the first and the second deflector surface has shown to result in the best deflection behavior of the dirt particles. On the other hand, the distance between the first and the second deflector surface as well as the angle $\gamma$ with which they are arranged relative to each other are limited by the size of the nozzle. A too large distance between the two deflector elements and a too large inclination of the second deflector element relative to the first deflector element would lead to a large height of the nozzle, which would make the nozzle rather bulky.

According to a further embodiment, the first deflector surface is during operation of the device arranged perpendicular to the surface to be cleaned (floor). The first deflector surface may, for example, be designed as a planar surface. In this case, the behavior of the dirt particles at the interface between the brush and the first deflector surface is almost perfectly the same as at the interface between the brush and the floor. However, the first deflector surface does not necessarily need to be arranged exactly perpendicular to the floor.

According to a further embodiment, the first deflector surface is tilted with respect to a vertical axis that is during operation of the device perpendicular to the surface to be cleaned. The first deflector surface may, for example, slightly face upwards towards the interior of the nozzle housing. This facilitates to guide the dirt particles in an upward direction away from the surface to be cleaned, as this will be explained further below.

According to a still further embodiment of the present invention, the second deflector surface is a curved surface that faces towards the inlet of the exhaust channel and is configured to guide the dirt and/or liquid particles that are released from the brush at the first deflector surface towards the inlet of the exhaust channel.

The second deflector surface may either be designed as a planar surface or as a curved surface. In case the second deflector surface defines a curved surface, the second deflector element may resemble an arch that is arranged above the inlet of the exhaust channel. This arch may have an elliptical shape, a semi-circular shape, or any other complex-curved shape. Such a curved or rounded shape of the second deflector element has shown to be especially advantageous in terms of cleanability. The rounded shape may be used so to speak to hold the funnel in which the dirt and/or liquid particles bounce forth and back between different sections of the second deflector surface. A rounded shape of the second deflector surface is relatively space-saving and may therefore be integrated into a small-sized nozzle. The specific shape of the curved second deflector surface is adapted to the dirt particle behavior, especially to the angles of incidence and the emergent angles with which the dirt particles bounce forth and back at the second deflector surface. This is explained in more detail with reference to the drawings.

It shall be noted that the second deflector element does not necessarily have a curved shape. The target of having a small-sized second deflector element may also be accomplished with planar surfaces. According to an alternative embodiment, the second deflector element further comprises a third deflector surface arranged adjacent to the second deflector surface and a fourth deflector surface arranged adjacent to the third deflector surface, wherein the third deflector surface is arranged transverse to the second deflector surface, and wherein the fourth deflector surface is arranged transverse to the second and the third deflector surface.

In this case, the second, the third and the fourth deflector surfaces together form an arched guiding configuration that faces towards the inlet of the exhaust channel and is configured to guide the dirt and/or liquid particles towards the inlet of the exhaust channel by deflecting them at the second and/or the third and/or the fourth deflector surface.

The arched guiding configuration may thus also be realized by several planar surfaces that are arranged next to each other and are slightly inclined relative to each other. Dirt and/or liquid particles that are released from the brush at the first deflector surface may first hit the second deflector surface, then the third deflector surface, and finally the fourth deflector surface before being finally deflected directly towards the inlet of the exhaust channel. In other words, the second deflector element in this embodiment does not only include one planar surface, but a plurality of planar surfaces. This leads to a "folded" funnel that guides the dirt and/or liquid particles away from the brush and towards the inlet of the exhaust channel. It is to be noted that it is herein only differentiated linguistically between said "folded funnel" and the exhaust channel. However, in practical appliance, the second deflector element, i.e. "the folded funnel", may be a part of the exhaust channel or the nozzle outlet.

It shall be also noted that the terms "first", "second", "third", "fourth" shall not imply a quantity, but are herein used to differentiate between the different "deflector elements" and the different "deflector surfaces". The above-described second, third and fourth deflector surfaces are different sections of the second deflector element, whereas the above-described first deflector surface is a part of the first deflector element. Both deflector elements are preferably parts of the nozzle housing.

The foregoing description mainly referred to the dirt manipulation configuration, i.e. how the dirt and/or liquid particles are guided away from the brush towards the exhaust channel within the nozzle arrangement. However, it has so far not been explained how the undesired effect of re-spraying the surface to be clean is overcome according to the present invention. Since the dirt particles are released from the brush as soon as the tip portions of the brush loose contact from the floor during the brush's rotation, not all of the dirt particles will adhere to the brush elements so that not all dirt particles will directly be transported together with the brush towards the interior of the nozzle housing, where the first deflector element is arranged. Some of the dirt particles or even a majority of the dirt particles will be launched from the brush after the brush elements have contacted the floor and will then be sprayed back to the floor right behind the position of the brush. This is also known as re-spraying effect.

To account for this effect an adjustment means may be provided for adjusting the position of the first deflector element relative to the surface to be cleaned depending on a direction of movement of the device, wherein the adjustment means is adapted to arrange the first deflector element in a first position in which the first deflector element has a first distance d1 to the surface to be cleaned when the cleaning device is moved in a forward direction, in which the first deflector element is, seen in the direction of movement of the device, located behind the brush, and to arrange the first deflector element in a second position in which the first deflector element has a second distance d2 to the surface to be cleaned, when the cleaning device is moved in an opposite backward direction, wherein the second distance d2 is larger than the first distance d1.

Accordingly, the position of the first deflector element can be changed depending on the direction of movement of the device. The first deflector element is in this case not only used as a deflector that touches a side part of the brush and releases dirt and/or liquid particles from the brush to deflect them towards the second deflector element (as explained above). It also serves as a so-called bouncer, which ensures that dirt and/or liquid particles, which are already released from the brush as soon as the tip portions of the brush lose contact from the surface, are collected and lifted as well.

Experiments have shown that, depending on the dirt properties (size and weight), the dirt particles leave the brush with an angle $\alpha$ of around 0-25° relative to the floor when the dirt is entering the brush along with the rotation of the brush. In contrast thereto, this release angle $\alpha$ has found to be in a range of around 10-60° when the dirt particles enter the brush against the brush's rotation. This means that the situation is different in a forward stroke of the nozzle than in a backward stroke.

The first deflector element may thereto be designed as an elastic element that is, for example, made of rubber or plastic. According to an embodiment, the first deflector element is part of a squeegee that comprises a flexible rubber lip. The first deflector element may furthermore comprise a bouncing surface that is arranged next to the first deflector surface. According to an embodiment these two surfaces are one and the same surface, wherein an upper part of said surface, that is farther away from the floor (surface to be cleaned), is denoted as first deflector surface and a lower part of said surface, that is arranged closer to the floor, is denoted as bouncing surface. In contrast to the first deflector surface the bouncing surface does not contact the brush.

Dirt and/or liquid particles, that are picked up by the brush and released from the brush as soon as the tip portions of the brush lose contact from the surface, may hit the bouncing surface of the first deflector element, rebound back to the brush and made airborne again by the rotating brush. In this way, the dirt and/or liquid particles are picked up by the brush, bounce forth and back between the brush and the bouncing surface in a zig-zag-like manner, and are lifted from the floor without the mandatory need of an external vacuum source.

Since the situation is different in a forward stroke of the nozzle than in a backward stroke (as explained above) it is meaningful to adjust the position of the first deflector element depending on the direction on the direction of movement of the device. In this way the benefits of the above-mentioned zig-zag-like bouncing effect occur in both movement direction. In the above described forward stroke of the device, the dirt is encountered by the brush along with the brush's rotation. Thus, the distance d1 between the first deflector element and the floor needs to be rather small, since the dirt is released in a rather flat manner (a being around 0-25°). It is to be noted that d1 denotes the distance between the bottom side of the first deflector element and the surface to be cleaned during the forward stroke of the device.

On the other hand, the first deflector element is in its second position arranged in a distance d2 to the surface, when the cleaning device is moved in the opposite backward direction, in which the first deflector element is, seen in the direction of movement of the device, located in front of the brush. The distance d2 also denotes the distance between the bottom side of the first deflector element and the surface to be cleaned but during the backward stroke of the device (compared to the distance d1 in the forward stroke of the device). The distance d2 needs to be large enough to let dirt and/or liquid particles enter the nozzle in order to be encountered by the brush. In other words, a gap needs to be formed between the lower surface of the first deflector element and the floor that is large enough for dirt and/or liquid particles to enter the nozzle. On the other hand, the vertical height of this gap (meaning the height perpendicular to the surface to be cleaned (floor)) may not be too large, since the dirt particles that are released from the brush during its rotation would then be thrown out of the nozzle, i.e. leave the nozzle through the gap between the first deflector element and the floor.

Therefore, d2 (backward stroke) needs to be larger than d1 (forward stroke), but small enough to guarantee that the released dirt particles hit the bouncing surface of the first deflector element to establish the above-described bouncing effect, i.e. that the dirt particles bounce forth and back between the bouncing surface and the brush and are lifted from the floor in this way.

Since the above-described experiments have shown that the release angle $\alpha$ is in a range of 10-60° when the dirt and/or liquid particles enter the brush against its rotation in the backward stroke, it has been found to be a good trade-off to arrange the first deflector element in this situation with a distance d2 to the surface to be cleaned (floor), wherein $d2=d3*\tan(\alpha)$, with a having a maximum value of 20°. Therein, d3 denotes the distance between the first deflector element and the position of the brush where the tip portions lose contact from the surface during the brush's rotation. In other words, distance d3 is the distance measured parallel to the surface to be cleaned from the point, where the dirt and/or liquid particles are released from the brush to the first point at which they bounce against the bouncing surface of the first deflector element.

It has to be noted that the value of 20° for $\alpha$ is not a randomly chosen value. A maximum value of 20° for $\alpha$ has been derived from the above-mentioned experimental results. It has been shown that the dirt particles are released from the brush in a kind of uniform distribution within the above-mentioned angle range. This means that in a backward stroke, where the dirt particles encounter the brush against the rotation direction, the amount of dirt particles that are released in a certain angle is uniformly distributed over the above-mentioned angle range of 10-60°, meaning that approximately the same amount of dirt leaves the brush with an angle of 60° relative to the surface as the amount that leaves the brush with an angle of 10° with respect to the surface.

A maximum angle $\alpha=20°$ thus results in a so-called dust pick-up ratio (dpu) of around 80%, meaning that the floor is freed from approximately 80% of the dirt that is located thereon. Of course, smaller values for $\alpha$ result in an even higher dpu. However, a value of 80% dpu is already higher than traditional vacuum cleaners. Bearing in mind that these traditional vacuum cleaners have to use an external vacuum source, whereas the device according to the present invention has a dpu of 80% without the need of a vacuum source, this is a surprisingly good result.

Decreasing the maximum value for $\alpha$increases the above-mentioned dpu ratio, since according to the given geometrical relationship this also decreases d2 (the gap between the first deflector element and the surface to be cleaned, or in other words, the exit gap for the dirt particles to leave the nozzle housing again). Decreasing the maximum value for a thus also decreases the probability that dirt particles, which have been picked up by the brush, leave the nozzle housing again and do not hit the bouncing surface of first deflector element in order to be lifted in the above-mentioned way.

According to an embodiment of the present invention, $\alpha$ is equal to or smaller than 15°, preferably equal to or smaller than 12°, more preferably in a range of 9° to 11°, and most preferably equal to 10°.

Assuming the above-mentioned uniform distribution of the dirt release, an angle of $\alpha=15°$ results in a dpu ratio of 90%. An angle of $\alpha=12°$ even results in a dpu ratio of around 96%. An angle of around 10° has proven to result in an almost complete removal of dust and dirt from the surface (a dpu ratio of around 100%).

The angle of 10° results from experiments, where rice has been used as test dirt. Rice especially has difficult material properties that make a removal with a brush fairly complicated. However, it has been shown that also rice leaves the brush at a minimum angle of around 10° when entering the brush against its rotation in the backward stroke of the device. The experiments have also shown that this minimum release angle does not vary too much with the rotational speed of the brush. During the experiments the minimum release angle stayed almost constant when the rotational speed of the brush was varied between 4,000 and 8,000 rpm and above (in which rpm=rotations per minute). Thus, optimal cleaning results enabling a dpu of around 100% may be achieved when choosing $\alpha$to be more or less equal to 10°.

In other words, optimal cleaning results have been received when the first deflector element has been positioned at a distance d2 to the surface, wherein d2 is chosen to be around $\tan(10°)*d3$. This value refers to the backward stroke, whereas the distance d1 of the first deflector element to the floor is preferably smaller in the forward stroke, since the dirt particles leave the brush in a smaller angle when entering the brush along with its rotation.

It is to be noted, that the terms forward and backward stroke or forward and backward movement are only definitions that are used herein to ease the understanding. However, these two definitions can be interchanged without leaving the scope of the invention, as long as the relationship between the brush and the first deflector element and their position to each other remain as defined above. In any case, independent of the forward and backward stroke, the first deflector element always needs to be arranged on the side of the brush where the dirt and/or liquid particles leave the brush.

According to an embodiment of the present invention, the adjustment means is adapted to arrange the first deflector element in the first position in a distance d1 of zero, wherein the bouncing element touches the surface to be cleaned (floor). Arranging the first deflector element so that it touches the surface (distance d1=0) enables the best possible cleaning result also in the forward stroke, in which the first deflector element is, seen in the direction of movement of the device, located behind the brush.

Since in this situation the dirt has been found to be released from the brush within an angle range of 0° to 25° relative to the floor, it is ensured that all dirt particles, also the dirt particles which are launched parallel to the floor, hit the bouncing surface of the first deflector element, rebound to the brush, are airborne again when encountering the brush elements again, and are lifted in the way explained above by bouncing forth and back in a zig-zag-like manner between the brush and the bouncing surface.

In case the distance d1 is chosen to be zero, the first deflector element may act as squeegee. The first deflector element may, for example, be realized by a flexible rubber squeegee that is attached to the bottom of the nozzle housing of the cleaning device. This squeegee is adapted to flex about its longitudinal direction, depending on the movement direction of the cleaning device.

According to this embodiment, said squeegee preferably comprises at least one or a plurality of studs, which are arranged near the lower end of the squeegee, where the squeegee is intended to touch the surface to be cleaned. In this embodiment the studs may be regarded as adjusting means for adjusting the position of the first deflector element. Said at least one stud is being adapted to at least partly lift the squeegee from the surface, when the cleaning device is moved on the surface in the above-described backward direction, in which the squeegee is, seen in the direction of movement of the cleaning device, located in front of the brush. In this case the squeegee is lifted, which is mainly due to natural friction which occurs between the surface and the studs, which act a kind of stopper that decelerates the squeegee and forces it to flip over the studs. The squeegee is thus forced to glide on the studs, wherein the squeegee is lifted by the studs and a gap occurs in the space between the rubber lip and the floor. The above-mentioned distance d2 between the first deflector element/squeegee and the surface may be realized by adapting the size of the studs, so that the studs lift the squeegee accordingly to a distance d2 from the surface to be cleaned. In this case, the above-mentioned geometrical relationship ($d2=d3*\tan(\alpha)$) is also guaranteed.

When using the above-described squeegee as the first deflector element, said studs are free from contact to the floor, when the cleaning device is moved on the surface in the opposite forward direction. The squeegee may thus freely glide over the floor and thereby wipes and collects dirt and/or liquid particles from said floor.

As explained above, the occurring accelerations at the tip portions of the brush elements cause the dirt particles to be automatically released from the brush, when the brush elements lose contact from the floor during their rotation. Since not all dirt particles and liquid droplets may be directly lifted in the above-manner (bouncing zig-zag-wise between the brush and the bouncing element), a small amount of dirt particles and/or liquid droplets will be flung back onto the surface in the area where the brush elements lose the contact from the surface. This effect of re-spraying the surface is overcome by the first deflector element that acts as a squeegee and collects the re-sprayed dirt and/or liquid by acting as a kind of wiper. As explained in the beginning, the first deflector element also serves as a deflector that imitates the floor with its first deflector surface, releases the dirt and/or liquid particles at the contact position of the brush and first deflector element, and deflects them towards the second deflector element, from where they are deflected towards the inlet of the exhaust channel. Said first deflector surface is also a part of said squeegee.

According to a further preferred embodiment of the present invention, the adjustment means is adapted to arrange the first deflector element in the second position with a second distance d2 relative to the surface to be cleaned, wherein d2 is in a range of 0.3 to 7 mm, preferably in a range of 0.5 to 5 mm, and most preferably in a range of 1 to 3 mm. This situation again refers to the above-mentioned backward stroke, in which the first deflector element is, seen in the direction of movement of the device, located in front of the brush.

It is to be noted that the named distance ranges are also not randomly chosen, but result from experiments of the applicant. First of all, it has been shown that by creating a gap of 7 mm, even the largest common dirt particles may enter the nozzle arrangement. On the other hand, as it can be seen from the above-mentioned geometrical relationship between d3 and d2 ($d2=d3*\tan(\alpha)$), increasing the distance d2 between the floor and the first deflector element also increases the distance d3 between the brush and the first deflector element when assuming that the release angle $\alpha$ is kept constant. However, the distance d3 between the brush and the first deflector element should not be too large, since this distance is limited by the kinetic energy of the dirt particles. Travelling from the brush to the bouncing surface of the first deflector element, the kinetic energy of the dirt particles will be lost by the air resistance of the dirt particles. Since there should be enough energy left to bounce back from the bouncing surface into the brush, d3 should not exceed a value of around 3 to 4 cm. Taking into account this limitation for d3, a limitation for d2 results in the above-mentioned distance ranges.

A distance d2 of around 1 to 3 mm has shown to be the best possible trade-off, wherein still most of the dirt particles may enter the nozzle and the distance d3 is small enough to establish the above-mentioned bouncing effect, and thus to realize a very good cleaning result.

In order to further improve the cleaning result, the bouncing surface of the first deflector element is, according to a further embodiment of the present invention, tilted with respect to a vertical axis that is perpendicular to the surface. In other words, the bouncing surface is inclined with respect to the vertical axis. Having this inclination the bouncing surface is no longer arranged perpendicular to the surface to be cleaned (the floor), but faces upwards, away from the floor. This allows an easier lift-up of the dirt particles that bounce against the bouncing surface, since due to the inclination of the bouncing surface the dirt particles are automatically reflected in an upward direction. Especially in case the dirt particles are released from the brush with a release angle of 0° (parallel to the floor) the dirt particles will bounce back from the bouncing surface in the inclination angle, thereby being lifted faster.

According to a further embodiment, the nozzle arrangement comprises a nozzle housing that at least partly surrounds the brush, and wherein the first deflector element is attached to said housing. In this arrangement the brush is at least partly surrounded by the nozzle housing and protrudes at least partly from a bottom side of said nozzle housing, which, during use of the device, faces the surface to be cleaned, so that the brush elements contact the floor outside of the housing during the rotation of the brush.

According to a further preferred embodiment of the present invention, the linear mass density of a plurality of the brush elements is, at least at the tip portions, lower than 150 g/10 km, preferably lower than 20 g/10 km. In contrast to brushes used according to the prior art, which are only used for stain removal (so-called adjutators), a soft brush with flexible brush elements as presented here also has the ability to pick-up water from the floor. Due to the flexible micro-fiber hairs that are preferably used as brush elements, dirt particles and liquid can be picked up from the floor when the brush elements/micro-fiber hairs contact the floor during the rotation of the brush. The ability to also pick-up water with a brush is mainly caused by capillary and/or other adhesive forces that occur due to the chosen linear mass density of the brush elements. The very thin micro-fiber hairs furthermore make the brush open for coarse dirt.

It is to be noted that the linear mass density as mentioned, i.e. the linear mass density in gram per 10 km, is also denoted as Dtex value. A very low Dtex value of the above-mentioned kind ensures that, at least at the tip portions, the brush elements are flexible enough to undergo a bending effect and are able to pick-up dirt particles and liquid droplets from the surface to be cleaned. Furthermore, the extent of wear and tear of the brush elements appears to be acceptable within this linear mass density range.

The experiments carried out by the applicant have proven that a Dtex value in the above-mentioned range appears to be technically possible and that good cleaning results can be obtained therewith. However, it has shown that cleaning results can be further improved by applying brush elements with an even lower upper limit of the Dtex value, such as a Dtex value of 125, 50, 20 or even 5 (in g/10 km).

According to a further preferred embodiment of the present invention, the drive means are adapted to realize a centrifugal acceleration at the tip portions of the brush elements which is, in particular during a dirt release period when the brush elements are free from contact to the surface during rotation of the brush, at least 3,000 $m/s^2$, more preferably at least 7,000 $m/s^2$, and most preferably 12,000 $m/s^2$.

It is to be noted that the minimum value of 3,000 $m/s^2$ in respect of the acceleration which is prevailing at the tip portions at least during a dirt release period when the brush elements are free from contact to the surface during the rotation of the brush, is also supported by results of experiments which have been performed in the context of the present invention. These experiments have shown that the cleaning performance of the device according to the present invention improves with an increase of the angular velocity of the brush, which implies an increase of the acceleration at the tip portions of the brush elements during rotation.

When the drive means are adapted to realize centrifugal accelerations of the brush elements in the above-mentioned ranges, it is likely for the liquid droplets adhering to the brush elements to be expelled as a mist of droplets during a phase in which the brush elements are free from contact to the surface to be cleaned.

Combining the above-mentioned parameters for the linear mass density of the flexible brush elements with the parameters for the acceleration of the tips of the brush elements yields optimal cleaning performance of the rotatable brush, wherein practically all dirt particles and spilled liquid encountered by the brush are picked up by the brush elements and expelled at a position inside the nozzle housing.

A good combination of the linear mass density and the centrifugal acceleration at the tip portions of the brush elements is providing an upper limit for the Dtex value of 150 g/10 km and a lower limit for the centrifugal acceleration of 3,000 $m/s^2$. This parameter combination has shown to enable for excellent cleaning results, wherein the surface is practically freed of particles and dried in one go. Using this parameter combination has also shown to result in very good stain removing properties. The ability to also pick-up liquid/water with a brush is mainly caused by capillary and/or other adhesive forces that occur due to the chosen linear mass density of the brush elements and the occurring high speeds with which the brush is driven.

The combination of the above-mentioned parameters concerning the linear mass density and the realized centrifugal acceleration at the tip portions of the brush elements is not found on the basis of knowledge of the prior art. The prior art is not even concerned with the possibility of having an autonomous, optimal functioning of only one rotatable brush which is used for cleaning a surface and is also able to lift dirt and liquid.

In order to realize the above-mentioned centrifugal accelerations at the tip portions of the brush elements, the drive means are, according to an embodiment of the present invention, adapted to realize an angular velocity of the brush which is in a range of 3,000 to 15,000 revolutions per minute, more preferably in a range of 5,000 to 8,000 revolutions per minute, during operation of the device. Experiments of the applicant have shown that optimal cleaning results can be obtained, when the brush is driven at an angular velocity which is at least 6,000 revolutions per minute.

However, the desired accelerations at the tip portions of the brush elements do not only depend on the angular velocity, but also on the radius, respectively on the diameter of the brush. It is therefore, according to a further embodiment of the invention, preferred that the brush has a diameter which is in a range of 10 to 100 mm, more preferably in a range of 20 to 80 mm, and most preferably in a range of 35 to 50 mm, when the brush elements are in a fully outstretched condition. The length of the brush elements is preferably in a range of 1 to 20 mm, more preferably in a range of 8 to 12 mm, when the brush elements are in a fully outstretched condition.

According to a further embodiment, the cleaning device further comprises a vacuum aggregate for generating an under-pressure within the exhaust channel for ingesting the dirt and/or liquid particles, wherein said under-pressure generated by the vacuum aggregate is in a range of 3 to 70 mbar, preferably in a range of 4 to 50 mbar, most preferably in a range of 5 to 30 mbar.

Even though a vacuum aggregate is, as mentioned above, not necessarily needed according to the present invention, an additional vacuum aggregate may further increase the cleaning performance. Especially the so-called effect of re-spraying the surface may be improved or overcome by providing this vacuum aggregate.

In contrast to the above-mentioned pressure ranges that are generated by the additional vacuum aggregate, state of the art vacuum cleaners need to apply higher under-pressures in order to receive acceptable cleaning results. However, due to the above-mentioned bouncing effect and the special technique of deflecting the dirt particles intelligently towards the exhaust channel as well as due to the above-mentioned properties of the brush, very good cleaning results may already be realized in the above-mentioned pressure ranges. Thus, also smaller vacuum aggregates may be used. This increases the freedom in the selection of the vacuum pump. Again, it is to be noted that a vacuum pump is not mandatory in order to receive better cleaning results as prior art cleaning devices.

The presented cleaning device may further comprise positioning means for positioning the brush axis at a distance to the surface to be cleaned that is smaller than the radius of the brush with fully outstretched brush elements, to realize an indentation of the brush part contacting the surface to be cleaned during operation, which indentation is in a range from 2% to 12% of the brush diameter.

As a result, the brush elements are bent when the brush is in contact with the floor. Hence, as soon as the brush elements come into contact with the floor during rotation of the brush, the appearance of the brush elements changes from an outstretched appearance to a bent appearance, and as soon as the brush elements lose contact with the floor during rotation of the brush, the appearance of the brush elements changes from a bent appearance to an outstretched appearance. The same brush characteristics occur when the tip portions of the brush contact the first deflection surface of the first deflection element.

A practical range for an indentation of the brush is arranged from 2% to 12% of a diameter of the brush relating to a fully outstretched condition of the brush elements. In practical situations, the diameter of the brush as mentioned can be determined by performing an appropriate measurement, for example, by using a high-speed camera or a stroboscope which is operated at the frequency of a rotation of the brush.

A deformation of the brush elements, or, to say it more accurately, a speed at which deformation can take place, is also influenced by the linear mass density of the brush elements. Furthermore, the linear mass density of the brush elements influences the power which is needed for rotating the brush. When the linear mass density of the brush elements is relatively low, the flexibility is relatively high, and the power needed for causing the brush elements to bend when they come into contact with the surface to be cleaned or with the first deflection surface is relatively low. This also means that a friction power which is generated between the brush elements and the floor or the first deflection surface is low, whereby any damages are prevented. Other advantageous effects of a relatively low linear mass density of the brush elements are a relatively high resistance to wear, a relatively small chance of damage by sharp objects or the like, and the capability to follow the surface to be cleaned in such a way that contact is maintained even when a substantial unevenness in the floor is encountered.

A factor which may play an additional role in the cleaning function of the rotatable brush is a packing density of the brush elements. When the packing density is large enough, capillary effects may occur between the brush elements, which enhance fast removal of liquid from the surface to be cleaned. According to an embodiment of the present invention the packing density of the brush elements is at least 30 tufts of brush elements per $cm^2$, wherein a number of brush elements per tuft is at least 500.

Arranging the brush elements in tufts forms additional capillary channels, thereby increasing the capillary forces of the brush for picking-up dirt particles and liquid droplets from the surface to be cleaned.

As it has been mentioned above, the presented cleaning device has the ability to realize extremely good cleaning results. These cleaning results can be even improved by actively wetting the surface to be cleaned. This is especially advantageous in case of stain removal. The liquid used in the process of enhancing adherence of dirt particles to the brush elements may be provided in various ways. In a first place, the rotatable brush and the flexible brush elements may be wetted by a liquid which is present on the surface to be cleaned. An example of such a liquid is water, or a mixture of water and soap. Alternatively, a liquid may be provided to the flexible brush elements by actively supplying the cleansing liquid to the brush, for example, by oozing the liquid onto the brush, or by injecting the liquid into a hollow core element of the brush.

According to an embodiment, it is therefore preferred that the cleaning device comprises means for supplying a liquid to the brush at a rate which is lower than 6 ml per minute per cm of a width of the brush in which the brush axis is extending. It appears that it is not necessary for the supply of liquid to take place at a higher rate, and that the above-mentioned rate suffices for the liquid to fulfill a function as a carrying/transporting means for dirt particles. Thus, the ability of removing stains from the surface to be cleaned can be significantly improved. An advantage of only using a little liquid is that it is possible to treat delicate surfaces, even surfaces which are indicated as being sensitive to a liquid such as water. Furthermore, at a given size of a reservoir containing the liquid to be supplied to the brush, an autonomy time is longer, i.e. it takes more time before the reservoir is empty and needs to be filled again.

It has to be noted that, instead of using an intentionally chosen and actively supplied liquid, it is also possible to use a spilled liquid, i.e. a liquid which is to be removed from the surface to be cleaned. Examples are spilled coffee, milk, tea, or the like. This is possible in view of the fact that the brush elements, as mentioned before, are capable of removing the liquid from the surface to be cleaned, and that the liquid can be removed from the brush elements under the influence of centrifugal forces as described in the foregoing. The above-mentioned effect of re-spraying the surface in the area between the brush and the bouncing surface of the first deflector element may be overcome by the first deflector element which collects this re-sprayed liquid and dirt by acting as kind of wiper (in the forward stroke), so that remaining liquid and dirt may then be ingested if an under-pressure is applied using an additional vacuum aggregate.

BRIEF DESCRIPTION OF THE DRAWINGS

These and other aspects of the invention will be apparent from and elucidated with reference to the embodiment(s) described hereinafter. In the following drawings

DETAILED DESCRIPTION OF EMBODIMENTS OF THE INVENTION

Figure 1:
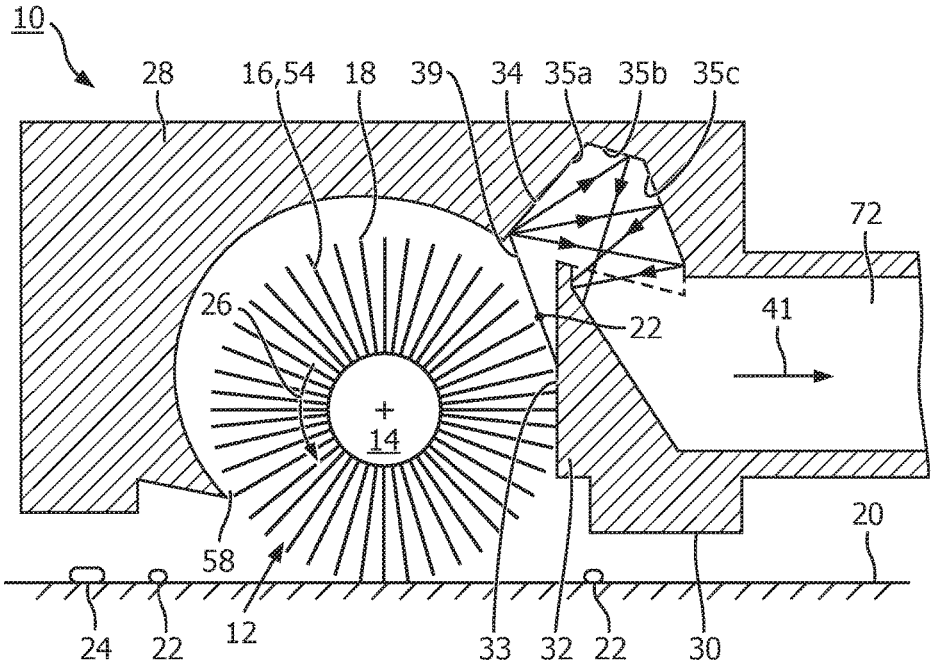
FIG. 1 shows a schematic cross-section of a first embodiment of a nozzle arrangement of a cleaning device according to the present invention.

FIG. 1 shows a schematic cross-section of a first embodiment of a nozzle arrangement 10 of a cleaning according to the present invention. The nozzle arrangement 10 comprises a brush 12 that is rotatable about a brush axis 14. Said brush 12 is provided with flexible brush elements 16 which are preferably realized by thin microfiber hairs. The flexible brush element 16 comprises tip portions 18 which are adapted to contact a surface to be cleaned 20 during the rotation of the brush and to pick-up dirt particles 22 and/or liquid particles 24 from said surface 20 (floor 20) during a pick-up period when the brush elements 16 contact the surface 20.

Further, the nozzle arrangement 10 comprises a drive means, e.g. a motor (not shown) for driving the brush 12 in a predetermined direction of rotation 26. Said drive means are preferably adapted to realize a centrifugal acceleration at the tip portions 18 of the brush elements 16 which is, in particular during a dirt release period when the brush elements 16 are free from contact to the surface 20 during the rotation of the brush 12, at least 3,000 $m/s^2$.

The brush 12 is at least partly surrounded by a nozzle housing 28. The arrangement of the brush 12 within the nozzle housing 28 is preferably chosen such that the brush 12 at least partially protrudes from a bottom side 30 of the nozzle housing 28. During use of the device 100, the bottom side 30 of the nozzle housing 28 faces towards the surface to be cleaned 20.

As shown in FIG. 1, the nozzle housing 28 furthermore comprises a first deflector element 32. The first deflector element 32 includes a first deflector surface 33 that extends substantially parallel to the brush axis 14. The first deflector surface 33 is configured to interact with the brush 12 during the rotation of the brush. It is preferably arranged such that it contacts the tip portions 18 of the brush 12 during the rotation of the brush 12. It is to be noted that the first deflector surface 33 does not necessarily have to contact the brush elements 16 while the brush is not rotating. As the brush elements 16 are usually straightened out during the brush's rotation, the effective diameter of the brush 12 usually increases as soon as the brush 12 rotates. The position of the first deflector surface 33 is preferably chosen such that it only contacts the tip portions 18 of the brush elements 16 during the brush's rotation.

According to an embodiment the first deflector surface 33 may also be slightly spaced apart from the tip portions of the brush (during the rotation of the brush 12). The distance between the first deflector surface and the tip portions of the brush is, during the rotation of the brush, preferably smaller than 2 mm, even more preferably smaller than 1 mm.

The first deflector element 32 is preferably a part of the nozzle housing 28. It serves as a deflector that releases the dirt and/or liquid particles 22, 24 that have been picked up by the brush 12 from the floor 20. The first deflector element 32 therefore allows guiding the picked-up dirt and/or liquid particles 22, 24 towards an exhaust channel 41. The usage of this first deflector element 32 causes a controlled dirt deflection at the first deflector surface 33 and prevents that the picked-up dirt and/or liquid particles 22, 24 are unpredictably scattered back and forth between the brush 12 and the interior of the nozzle housing 28.

Figure 7A:
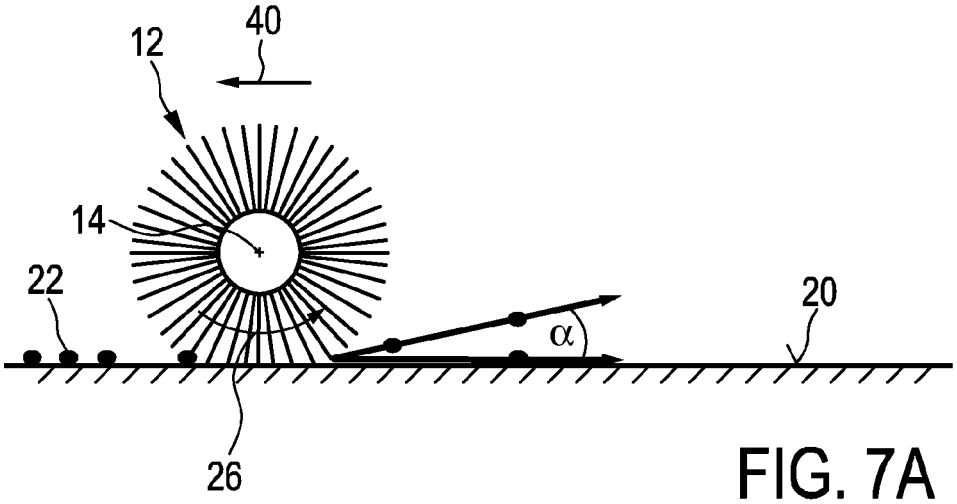
FIG. 7A schematically illustrates a dirt release from a brush that is used according to the present invention, wherein the cleaning device is in the second working position.
Figure 7B:
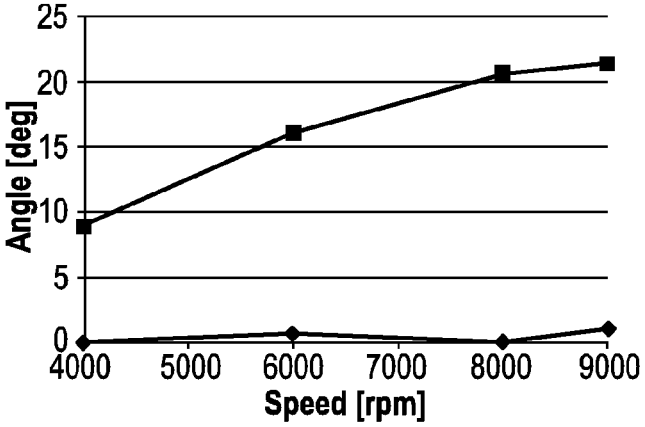
FIGS. 7B and 7C show graphs including the corresponding measurement results for different dirt particles.
Figure 7C:
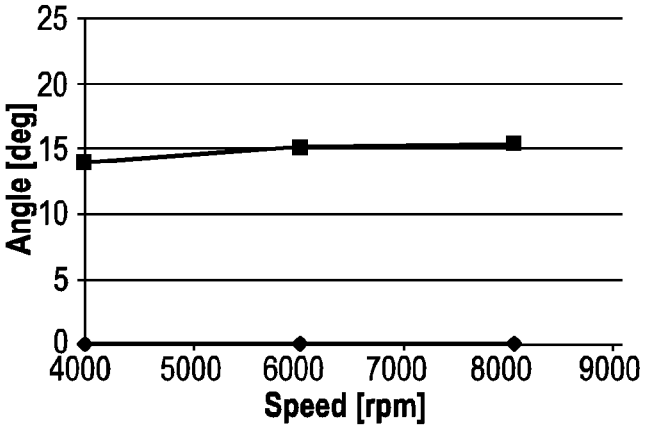
Figure 8A:
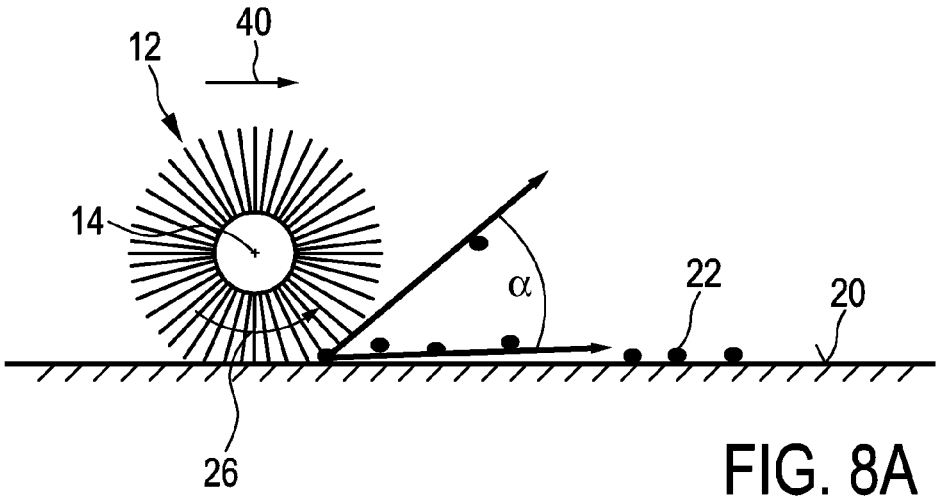
FIG. 8A schematically illustrates a dirt release from the brush that is used according to the present invention, wherein the cleaning device is in the first working position.
Figure 8B:
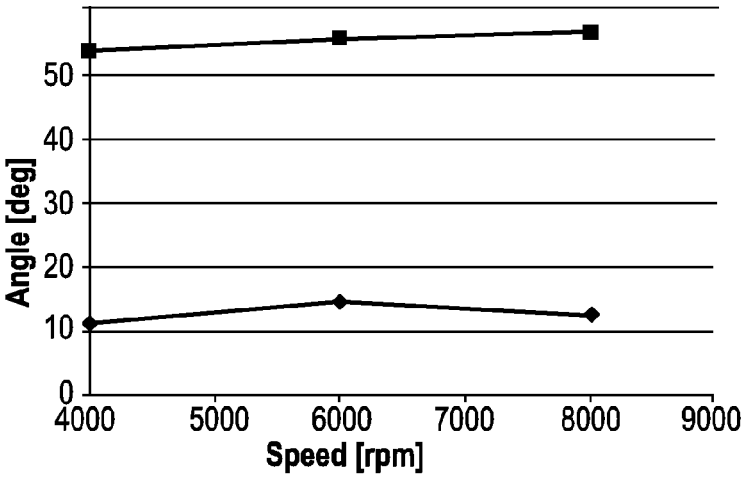
FIG. 8B shows a graph including the corresponding measurement results.

The idea how to create a predictable and controlled deflection behavior of the dirt particles 22 at the first deflector surface 33 can be explained by referring to FIGS. 7 and 8. Experiments of the applicant, in which a high speed camera recorded how dirt particles leave the brush 12, have shown that the direction of entering the brush 12 influences the so-called dirt release angle $\alpha$ of the dirt 22 when leaving the brush 12. FIGS. 7*a* and 7*b* show the two different situations and FIGS. 7*b*, 7*c* and 8*b* show the corresponding experimental results. FIG. 7*a* illustrates the behavior of the dirt particles 22 in a forward stroke of the nozzle 10, where the dirt particles 22 enter the brush 12 from the left side. The movement direction of the nozzle is indicated by arrow 40. During the forward stroke (illustrated in FIG. 7*a*) the dirt particles 22 enter the brush 12 along with the direction of rotation 26 of the brush 12.

The corresponding experimental results are shown in FIGS. 7*b* and 7*c*. The graphs illustrated in these figures show the relationship of the release angle $\alpha$ in dependence on the rotational speed with which the brush 12 is driven. FIG. 7*b* shows this relationship for rice that has been used as test dirt, whereas FIG. 7*c* shows the corresponding relationship for sugar as test dirt. The upper graphs in these figures show the upper limit of the release angle $\alpha$. The lower graphs instead show the lower limit of the release angle $\alpha$.

It can be seen that the dirt particles 22 are released from the brush with a release angle $\alpha$ that ranges, at least for rice, between 0-25°, when the dirt particles 22 enter the brush 12 along with the brush's rotation (as illustrated in FIG. 7*a*).

FIG. 8*a* shows the backward stroke of the nozzle, wherein the nozzle is moved in the opposite directions (compare the direction of arrow 40 in FIGS. 7*a* and 8*a*, which indicates the direction of movement of the nozzle 10). FIG. 8*b* shows the corresponding experimental results for rice used as test dirt. It can be seen that the behavior of the dirt 22 is totally different in the backward stroke of the nozzle (see FIG. 8) than in the forward stroke of the nozzle (see FIG. 7). Dirt particles 22 that enter the brush 12 during the backward stroke against the brush's rotation (see FIG. 8*a*) are launched from the brush 12 with a release angle $\alpha$ that ranges between approximately 10° and approximately 60° (see FIG. 8*b*).

These experiments have shown that the release angle $\alpha$ with which the dirt particles 22 are released from the brush 12 as soon as the tip portions loose contact from the surface to be cleaned 20 can be predicted. One only has to know from which side the dirt particles 22 enter the brush 12, either along with the rotation of the brush 12 or against the rotation of the brush 12.

As the launching direction of the dirt particles 22 is known to be within an angle range of 0-25° when the dirt particles enter the brush 12 along with the direction of rotation, this behavior of the dirt particles 22 may be used to achieve a more or less controlled behavior at the first deflection element 32 (see FIG. 1). Since the brush 12 contacts the first deflector surface 33 of the first deflector element 32 in a similar way as it contacts the surface to be cleaned 20 (floor 20), the dirt behavior at the interface between the brush 12 and the first deflector surface 33 will be pretty much the same as at the interface between the brush 12 and the floor 22. As the dirt particles 22 also at this position enter the brush 12 along with the direction of rotation 26, the dirt particles 22 will be released from the brush 12 at the first deflector surface 33 with an angle of 0-25° relative to the surface 33. The first deflector surface 33 therefore so to speak imitates a further contact between the brush 12 and the floor 20. Due to the first deflector element 32 it is therefore known how the dirt particles will be launched from the brush 12 within the interior of the nozzle housing 28, i.e. at an angle of 0-25° relative to the first deflector surface 33. In other words, the dirt release angle $\alpha_1$ occurring at the first reflector surface 33 (see FIG. 2) will be pretty much the same as the dirt release angle $\alpha$ occurring at the floor 20 when the dirt particles 20 enter the brush 12 along with the direction of rotation 26 of the brush (as illustrated in FIG. 7*a*). Hence, the behavior of the dirt particles 22 becomes predictable by means of the first deflector element 32.

Figure 2:
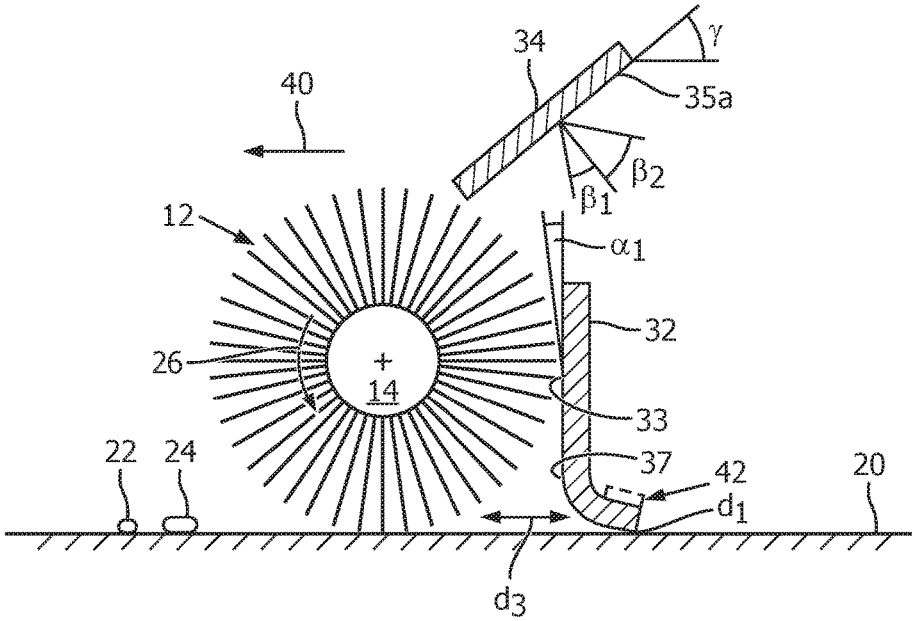
FIG. 2 schematically illustrates the technical principle of the present invention using a first and a second deflector element to deflect and collect dirt and/or liquid, wherein the cleaning device is in a first working position.

This predictable dirt release behavior at the first deflector surface 33 may be exploited by providing a second deflector element 34 that is spaced apart from the brush 12 and the first deflector element 32 (see FIG. 1). Said second deflector element 34 is used to guide the dirt and/or liquid particles 22, 24 that are released from the brush 12 at the first deflector surface 33 into the exhaust channel 41. The released dirt and/or liquid particles 22, 24 will therefore be deflected at the second deflector element 34 similar as a billiard ball that is deflected or reflected at the edges of a billiard table. As schematically illustrated in FIG. 2, the second deflector element thereto comprises a second deflector surface 35*a* that is oriented transverse to the first deflector surface 33. The second deflector surface 35*a* is configured to deflect the dirt and/or liquid particles 22, 24 into the exhaust channel 41. It is evident that the second deflector surface 35*a* must be at least slightly tilted relative to the first deflector surface 33.

According to an embodiment of the present invention, this tilt angle $\gamma$ (see FIG. 2) is chosen to be within a range of 5° to 50°, more preferably in a range of 10° to 40°. An angle of $\gamma$=30° has shown to result in the best dirt deflection behavior. If the first deflector surface 33 is arranged perpendicular to the floor 20, this of course means that $\gamma$ is the angle between the second deflector surface 35*a* and the horizontal (as shown in FIG. 2). However, it shall be noted that the first deflector surface 33 does not necessarily need to be arranged exactly perpendicular to the surface to be cleaned 20. It may also be tilted with respect to the vertical axis. So, more generally, the tilt angle $\gamma$ is between the second deflector surface 35*a* and a normal vector of the first deflector surface 33.

The usage of two deflector elements 32, 34 has shown to create a well-defined dirt particle behavior and allows guiding the dirt particles 22, 24 in a well-controlled manner into the exhaust channel 41. High speed camera recordings have been made to visualize the trajectories of the dirt particles during their deflection at the first and the second deflector elements 32, 34.

Figure 4:
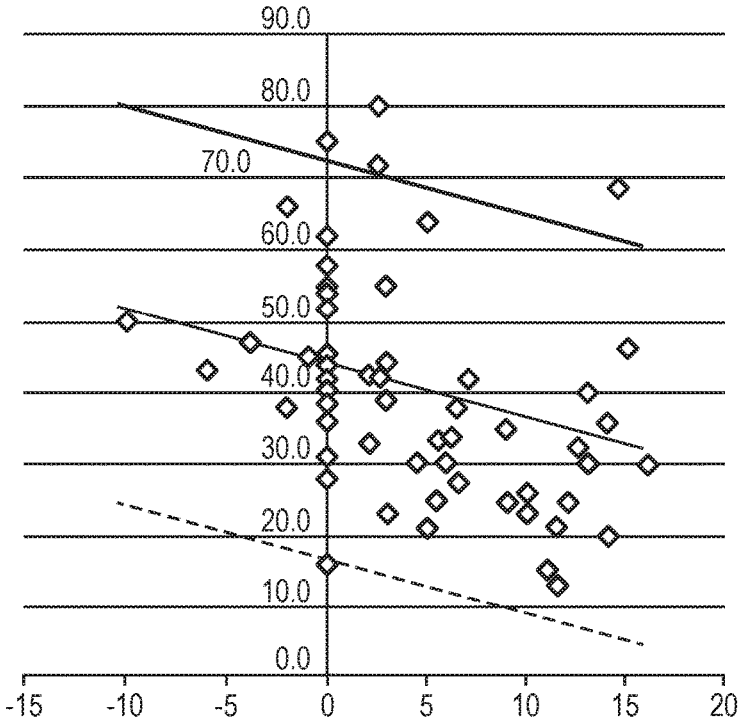
FIG. 4 shows a graph which serves for illustrating a relation between an emergent angle with which the dirt and/or liquid leaves the first deflector element and an emergent angle with which the dirt and/or liquid leaves the second deflector element.

FIG. 4 illustrates the experimental results of these high speed camera recordings. The graph illustrates the dependency of the angle of incidence $\beta_2$ (on the vertical axis) with which the dirt particles 22 bounce from the second deflector surface 35*a* versus the dirt release angle $\alpha_1$ at the first deflector surface 33 (on the horizontal axis). For these test measurements, a relative angle $\gamma$=30° (angle between the first deflector surface 33 and the second deflector surface 35*a*) has been chosen.

The graph shows that the majority of dirt particles 22 are released from the brush 12 at the interface between the brush and the first deflector surface 33 at an angle of $\alpha_1$=0°. The maximum angle $\alpha_1$ with which the dirt particles 22 are deflected at the first deflector surface 33 is somewhere around $\alpha_1$=15°, for sure smaller than $\alpha_1$=25° (as explained before). This means that the position of the second deflector element 34 may be fairly good determined. The outer border of the second deflector element 34 shall be positioned such that all dirt particles 22 that are deflected at the first deflector surface 23 under an angle $\alpha_1$ of maximum 25° should still hit the second deflector surface 35*a*.

FIG. 4 furthermore shows that the majority of dirt particles 22 is deflected at the second deflector surface 35*a* with an angle of $\beta_2$=45°±20°. In other words, the behavior of the dirt particles 22 is after having been deflected at the second deflector surface 35*a* still predictable. The experiments have shown that most of the dirt particles 22 will leave the second deflector element 34 with an angle $\beta_2$ between 20° and 50°. This dirt particle behavior is extremely important to know as it helps to design the dirt manipulation configuration.

Figure 5A:
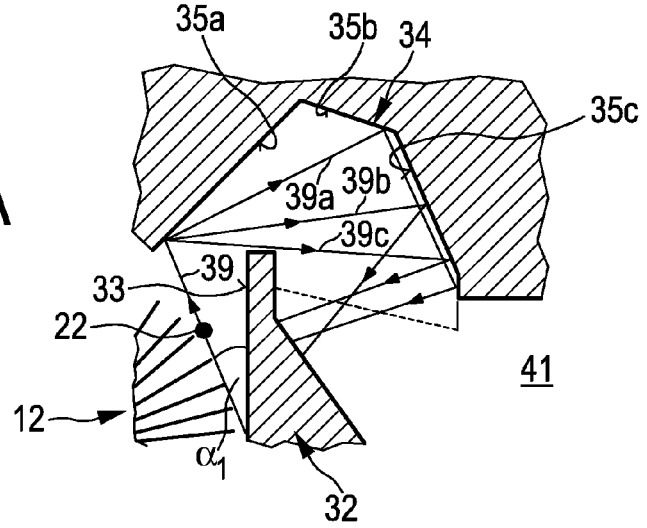
FIGS. 5A and 5B show an enlarged view of the first embodiment of the nozzle arrangement shown in FIG. 1 to illustrate the deflection of the dirt and/or liquid at the first and second deflector element in a schematic view.
Figure 5B:
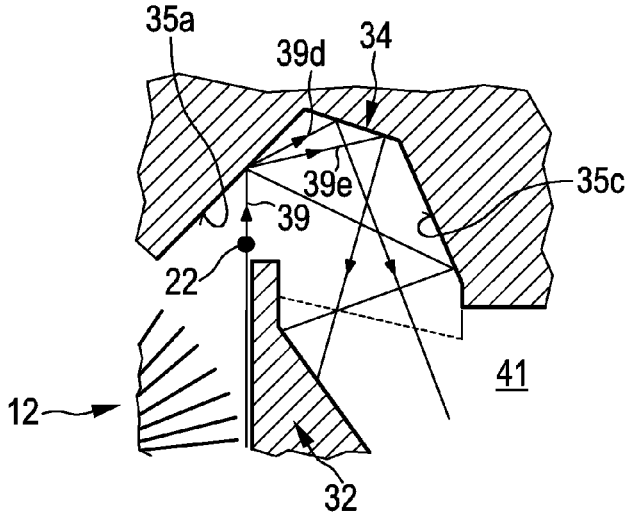

According to a preferred embodiment of the present invention, the second deflector element 34 preferably comprises not only a second deflector surface 35*a*, but also further deflector surfaces 35*b*, 35*c*, which are in the following denoted as third deflector surface 35*b* and fourth deflector surface 35*c*. An enlarged view of such a deflector element 34 is shown in FIGS. 5*a* and 5*b*. As shown therein, the second deflector element 34 comprises a third deflector surface 35*b* arranged adjacent to the second deflector surface 35*a* and a fourth deflector surface 35*c* arranged adjacent to the third deflector surface 35*b*. All of these deflector surfaces 35*a-c* are arranged transverse to each other. They form a kind of arched guiding configuration that faces into the exhaust channel 41. The arrangements and positions of the deflector surfaces 35*a-c* is derived from the experimental results (the dirt particle behavior) that have been discussed above with reference to FIG. 4.

As shown in FIGS. 5*a* and 5*b*, the second deflector element 34 has the shape of a folded arch. Such a shape of the second deflector element 34 is especially advantageous, since it results in a space-saving arrangement. The height and even more the length of the nozzle housing 28 may thus be kept as small as possible.

FIGS. 5*a* and 5*b* furthermore show the deflection behavior of exemplary dirt particles 22. Trajectories (see reference numeral 39) indicate how the dirt particles 22 bounce forth and back between the deflector surfaces 35*a*, 35*b* and 35*c* into the exhaust channel 41. FIG. 5*a* schematically illustrates a dirt particle 22 that is released from the brush 12 at the first deflector surface 33 with an angle $\alpha_1$ of around 20°. This dirt particle 22 is then deflected at the second deflector surface 35*a* and may then either follow trajectory 39*a*, trajectory 39*b* or trajectory 39*c* or any trajectory in between (not explicitly shown). It will be either deflected at the third deflector surface 35*b* and/or at the fourth deflector surface 35*c*, so that it finally finds its way into the exhaust channel 41, from where it may be ingested by a vacuum aggregate.

FIG. 5*b* shows the situation for a dirt particle 22 that is released from the brush 12 at the first deflector surface 23 with an angle $\alpha_1$ of 0°. In this case, the dirt particle 22 follows trajectory 39*d* or 39*e* and is deflected at the third deflector surface 35*b* and/or at the fourth deflector surface 35*c* in order to be guided into the exhaust channel 41.

Due to the inclination angle γ (angle between the second deflector surface 35*a* and the first deflector surface 33) the dirt particles 22 are in any case deflected away from the brush 12. It is to be noted that in practice the dirt particles 22 do not exactly follow the depicted trajectories 39 in such a straight manner as this is illustrated in FIGS. 5*a* and 5*b*, since the dirt particles usually do not show a perfectly elastic behavior. The trajectories illustrated in FIGS. 5*a* and 5*b* shall only show the particle behavior in a schematical manner.

Figure 6:
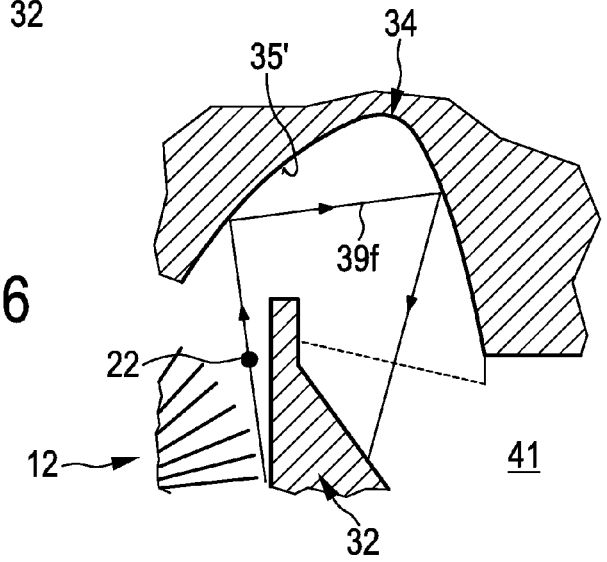
FIG. 6 schematically illustrates a second embodiment of the second deflector element.

FIG. 6 shows the second deflector element 34 according to a second embodiment of the present invention. In contrast to the embodiment shown in FIGS. 5*a* and 5*b*, the second deflector surface 35' has a rounded shape. The second deflector surface 35' is designed as a curved surface that faces into the exhaust channel 41. Similar as before, the shape of this curved surface 35' is configured to guide the dirt and/or liquid particles 22, 24 that are released from the brush 12 at the first deflector surface 33 into the exhaust channel 41. An exemplary trajectory 39*f* is shown to illustrate that such a curved surface 35' causes a very similar deflection behavior of the dirt particles 22 as the planar deflector surfaces 35*a-c*.

Figure 3:
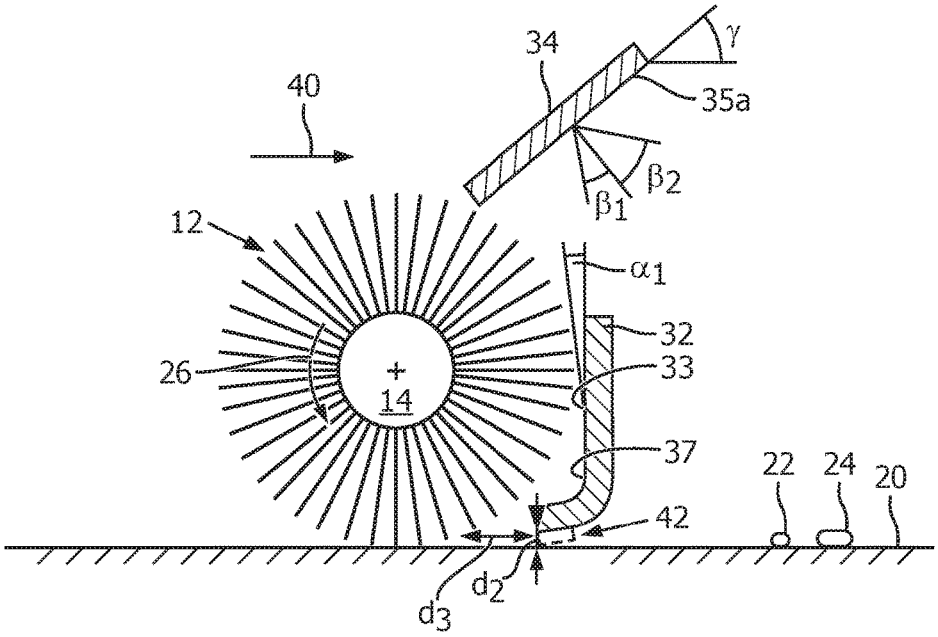
FIG. 3 schematically illustrates the technical principle of the present invention using a first and a second deflector element to deflect and collect dirt and/or liquid, wherein the cleaning device is in a second working position.

FIGS. 2 and 3 illustrate a further function of the first deflector element 32. The first deflector element 32 also has the function to act as a so-called bouncing element. It ensures that dirt and/or liquid particles 22, 24, which are already released from the brush 12 as soon as the tip portions 18 of the brush 12 loose contact from the floor 20, are collected and lifted as well. The first deflector element 32 thereto comprises a bouncing surface 37 that is arranged next to the first deflector surface 33. In the illustrated example, these two surfaces 33, 37 are one and the same surface, wherein an upper part of said surface, that is farther away from the floor 20, is denoted as first deflector surface 33 and a lower part of said surface, that is arranged closer to the floor, is denoted as bouncing surface 37.

Dirt and/or liquid particles 22, 24 that are released from the brush 12 as soon as the brush elements 16 loose contact from the floor 20 may be launched against said bouncing surface 37. These dirt and/or liquid particles 22, 24 may rebound back to the brush 12 and made airborne again by the rotating brush 12. In this way, the dirt particles are picked up by the brush 12 while bouncing forth and back between the brush and the bouncing surface 37 in a zig-zag-like manner.

The described zig-zag-like lifting manner results from the fact that the dirt particles 22 are reflected at the bouncing surface 37, so that the dirt particles 22 automatically move relatively upwards when being rebound on the bouncing surface 37. Hitting again the brush elements 16 after being rebound from the bouncing surface 37 moves the dirt particles 22 further upwards due to the rotation of the brush 12 that is at this position directed upwardly. After hitting the bouncing surface 37 and the brush 12 a couple of times, the dirt particles 22 are automatically lifted away from the floor 20. As soon as the dirt particles 22 will reach the upper part of the first deflector element 32, where the brush 12 contacts the first deflector surface 33, the dirt particles 22 will be deflected towards the second deflector element 34 as this has been explained above.

To account for the different behaviors of the dirt particles 22 in a forward stroke compared to a backward stroke of the nozzle 10, an adjustment mechanism 44 (schematically indicated by an arrow 42 FIGS. 2 and 3) is provided that is configured to adjust the position of the first deflector element 32 relative to the surface 20. The adjustment mechanism 44 adjust the position of the first deflector element 32 depending on the movement direction 40 of the nozzle 10. The bouncing element 32 is in a forward stroke, when the dirt particles 22 enter the brush 12 along with the brush's rotation, preferably arranged at a distance dl of zero to the surface 20. This situation is schematically shown in FIG. 2. It shall be noted that the "forward stroke" as used herein denotes the movement direction of the nozzle, in which the first deflector element is, seen in the direction of movement of the device, located behind the brush (see FIG. 2). The "backward stroke" instead denotes the opposite movement direction of the nozzle (see FIG. 3).

As it is shown in FIG. 2, the first deflector element 32 is during the forward stroke in its lowest position, so that no dirt particles 22 may leave the nozzle 10 without bouncing forth and back between the bouncing surface 37 and the brush 12. Even if a dirt particle 22 is released from the brush at an angle α of 0° (parallel to the surface 20), it will bounce against the bouncing surface 37 and thus be thrown back to the brush 12. The particle 22 that is in this way thrown back to the brush 12 encounters the brush 12 against the brush's rotation, so that a similar situation occurs as in a backward stroke. The resulting release angle α will thus be larger, so that the dirt particles 22 may be lifted in the above-described zig-zag-wise manner.

FIG. 3 schematically shows the situation for the backward stroke of the nozzle 10, where the dirt particles 22 enter the brush 12 against its rotation. As the above-described experiments have shown that the release angle α is in this situation in a range of 10°-60° (see FIGS. 8*a*, 8*b*). It has been found to be a good trade-off to arrange the first deflector element 32 in this situation with a distance d2 to the surface.

The distance d2 between the first reflector element 32 and the surface 20 is in this situation preferably chosen to be equal to d3*tan(α), with αhaving a maximum value of 20°. The distance d3 denotes the distance between the brush 12 and the bouncing surface 37. This distance is measured from the point where the tip portions 18 of the brush elements 16 lose contact from the surface 20 during the brush's rotation, since this is the point where the dirt and/or liquid particles 22, 24 are usually released from the brush 12.

Since the smallest dirt release angle α, that occurs in a backward stroke, has shown to be around 10° (see FIG. 8B), more or less all dirt particles bounce against the bouncing surface 37, if the first deflector element 32 is arranged at a distance d2=d3*)tan(10° from the surface 20. Using the above-mentioned bouncing technique this would thus result in a dust pick up ratio (dpu) of around 100%. However, the gap between the lower surface of the first deflector element 32 and the surface to be cleaned 20 should not be too small. Otherwise, larger dirt particles 22 could not enter the exhaust channel 41 in the backward stroke. Thus, d2 should be in a range of 0.3 to 7 mm, preferably in a range of 0.5 to 5 mm, and most preferably in a range of 1 to 3 mm.

The above-mentioned geometrical relationship for d2 is furthermore dependent on d3. The distance d3 between the brush 12 and the bouncing surface 37 should instead not be too large, since this distance d3 is limited by the kinetic energy of the dirt particles 22. In other words, the dirt particles 22 would not be able to reach the bouncing surface 37, respectively being rebound to the brush 12, when the distance d3 becomes too large. Travelling from the brush 12 to the first deflector element 32 the kinetic energy of the dirt particles 22 will be lost by the air resistance of the dirt particles 22. Since there should be enough energy left to bounce back from the bouncing surface 37 into the brush 12, d3 should not exceed a value of around 3 to 4 cm.

The above-mentioned limitations for d2 and d3 can be met in a good manner, when choosing d2 to be equal or less than d3*tan(20°). If d2 is set to be exactly equal to d3*tan (20°), this has shown to result in a dpu (dust pick-up ratio) of around 80%, which is compared to prior art devices that only make use of a combination of a brush and a vacuum source and therewith reach a dpu of 75%, still a better cleaning result.

The adjustment mechanism 44 for adjusting the position of the first deflector element 32 depending on the movement direction 40 may be realized in many ways. One possibility to adjust the position d2 of the first deflector element 32 is to realize the first deflector element 32 as a squeegee (a flexible rubber lip) that glides over the surface 20 in the forward direction, and is lifted by the adjustment mechanism 44, for example studs that are arranged on the lower side of the squeegee in order to force it to flip and being lifted to the above-mentioned distance d2 when the device 100 is moved in the backward direction. In this arrangement the first deflector surface 33 is a part of the squeegee. As explained the squeegee acts as a bouncing element and as a deflector element.

According to this embodiment, said squeegee preferably comprises at least one or a plurality of studs, which are arranged near the lower end of the squeegee, where the squeegee is intended to touch the surface 20 to be cleaned. In this embodiment the studs may be regarded as the adjustment mechanism 44 shown in FIGs. 2 and 3 schematically, which is arranged near the lower end of the of the first deflector element 32 for adjusting the position of the first deflector element 32. Said at least one stud is being adapted to at least partly lift the squeegee from the surface 20, when the cleaning device is moved on the surface 20 in the above-described backward direction, in which the squeegee is, seen in the direction of movement of the cleaning device, located in front of the brush 12. In this case the squeegee is lifted, which is mainly due to natural friction which occurs between the surface 20 and the studs, which act a kind of stopper that decelerates the squeegee and forces it to flip over the studs. The squeegee is thus forced to glide on the studs, wherein the squeegee is lifted by the studs and a gap occurs in the space between the rubber lip and the surface 20 (e.g., a floor). The above-mentioned distance d2 between the first deflector element/squeegee 32 and the surface 20 may be realized by adapting the size of the studs, so that the studs lift the squeegee accordingly to a distance d2 from the surface 20 to be cleaned. In this case, the above-mentioned geometrical relationship (d2=d3 * tan(α)) is also guaranteed (see discussion herein).

In the following further properties of the brush 12 and the rotational speed with which the brush 12 is driven shall be presented. The brush 12 preferably has a diameter which is in a range of 20 to 80 mm, and the driving means may be capable of rotating the brush 12 at an angular velocity which is at least 3,000 revolutions per minute, preferably at an angular velocity around 6,000 rpm and above. A width of the brush 12, i.e. a dimension of the brush 12 in a direction in which the rotation axis 14 of the brush 12 is extending, may be in an order of 25 cm, for example.

On an exterior surface of a core element 52 of the brush 12, tufts 54 are provided. Each tuft 54 comprises hundreds of fiber elements, which are referred to as brush elements 16. For example, the brush elements 16 are made of polyester or nylon with a diameter in an order of about 10 micrometers, and with a Dtex value which is lower than 150 g per 10 km. A packing density of the brush elements 16 may be at least 30 tufts 54 per $cm^2$ on the exterior surface of the core element 52 of the brush 12.

The brush elements 16 may be arranged rather chaotically, i.e. not at fixed mutual distances. Furthermore, it shall be noted that an exterior surface of the brush elements 16 may be uneven, which enhances the capability of the brush elements 16 to catch liquid droplets 24 and dirt particles 22. In particular, the brush elements 16 may be so-called microfibers, which do not have a smooth and more or less circular circumference, but which have a rugged and more or less star-shaped circumference with notches and grooves. The brush elements 16 do not need to be identical, but preferably the linear mass density of a majority of a total number of the brush elements 16 of the brush 12 meets the requirement of being lower than 150 g per 10 km, at least at tip portions 18.

By means of the rotating brush 12, in particular by means of the brush elements 16 of the rotating brush 12, dirt particles 22 and liquid 24 are picked up from the surface 20, and are transported to the exhaust channel 72 inside the cleaning device 100 in the above-explained manner. The occurring accelerations at the tip portions 18 of the brush elements 16 cause the dirt particles 22 and liquid droplets 24 to be automatically released from the brush 12, when the brush elements 16 lose contact from the floor 20 during their rotation. Most of the particles then bounce against the bouncing surface 37 of the first deflector element 32. Since not perfectly all dirt particles 22 and liquid droplets 24 hit the bouncing surface 37 and are lifted in the above-mentioned manner or may be directly ingested by the vacuum aggregate 38 (in case an additional vacuum aggregate 38 is provided), a small amount of dirt and liquid will be flung back onto the surface 20 in the area where the brush elements 16 lose the contact from the surface 20. However, this effect of re-spraying the surface 20 is overcome by the first deflector element 32 which collects this re-sprayed liquid and dirt by acting as kind of wiper in the forward stroke, so that the remaining liquid 24 and dirt 22 may then be ingested due to the applied under-pressure. The liquid 24 and dirt 22 does therefore not leave the housing 28 again without bouncing upwards, then being deflected from the first deflection surface 32 to the second deflections surface 35*a*, and finally being ingested.

It appears from the foregoing that the brush 12 according to the present invention preferably has the following properties:

- the soft tufts 54 with the flexible brush elements 16 will be stretched out by centrifugal forces during the contact-free part of a revolution of the brush 12;
- it is possible to have a perfect fit between the brush 12 and the surface 20 to be cleaned, since the soft tufts 54 will bend whenever they touch the surface 20, and straighten out whenever possible under the influence of centrifugal forces;
- the brush 12 constantly cleans itself, due to sufficiently high acceleration forces, which ensures a constant cleaning result;

heat generation between the surface 20 and the brush 12 is minimal, because of a very low bending stiffness of the tufts 54;

a very even pick-up of liquid from the surface 20 and a very even overall cleaning result can be realized, even if creases or dents are present in the surface 20, on the basis of the fact that the liquid 24 is picked up by the tufts 54 and not by an airflow as in many conventional devices; and dirt 22 is removed from the surface 20 in a gentle yet effective way, by means of the tufts 54, wherein a most efficient use of energy can be realized on the basis of the low stiffness of the brush elements 16.

On the basis of the relatively low value of the linear mass density, it may be so that the brush elements 16 have very low bending stiffness, and, when packed in tufts 54, are not capable of remaining in their original shape. In conventional brushes, the brush elements spring back once released. However, the brush elements 16 having the very low bending stiffness as mentioned will not do that, since the elastic forces are so small that they cannot exceed internal friction forces which are present between the individual brush elements 16. Hence, the tufts 54 will remain crushed after deformation, and will only stretch out when the brush 12 is rotating.

In comparison with conventional devices comprising hard brushes for contacting a surface to be cleaned, the brush 12 which is preferably used according to an embodiment of the present invention is capable of realizing cleaning results which are significantly better, due to the working principle according to which brush elements 16 are used for picking up liquid 24 and dirt 22 and taking the liquid 24 and the dirt 22 away from the surface 20 to be cleaned, wherein the liquid 24 and the dirt 22 are flung away by the brush elements 16 before they contact the surface 20 again in a next round.

As a result of the fact that the brush 12 is indented by the surface 20 to be cleaned, the brush 12 acts as a kind of gear pump which pumps air from the inside of the nozzle housing 28 to the outside. This is an effect which is disadvantageous, as dirt particles 22 are blown away and droplets of liquid 24 are formed at positions where they are out of reach from the brush 12 and can fall down at unexpected moments during a cleaning process.

In order to compensate for the pumping effect as mentioned, it is proposed to have means for generating an airflow in an area where the brush 12 contacts the surface 20, which airflow is used to compensate for the airflow generated by the brush 12.

These means can be realized in various ways. A first implementation possibility is shown in FIG. 1, where a small opening 58 is arranged between nozzle housing 28 and the brush 12 at a position where the brush elements 16 leave the nozzle housing 28 during the rotation of the brush 12. This opening 58 realizes a further suction inlet which applies an under-pressure in the area where the brush elements 16 first contact the surface 20. This under-pressure generates an airflow that counteracts the unwanted turbulent airstream that is generated in front of the brush 12 due to its rotation during use.

A second possibility to counteract the unwanted turbulent airstream in front of the brush 12, is to equip the brush 12 with tufts 54 of brush elements 16 which are arranged in rows on the brush 12, so that the necessary suction power will be significantly reduced.

Furthermore, it is possible to use a deflector for indenting the brush 12 at the position, seen in rotation direction 26, before the brush 12 contacts the surface 20 (at the position the small opening 58 or instead of the small opening 58, respectively). The deflector has the function to press the brush elements 16 together by deflecting them. In this way air, which is present in the space between the brush elements 16, is pushed out of said space. When the brush elements 16 are, after leaving the deflector, moved apart from each other again, the space in between the brush elements 16 increases so that air will be sucked into the brush 12, wherein an under-pressure is created that sucks in dirt 22 and liquid particles 24. This again compensates for the air blow that is generated by the rotating brush 12. Examples of deflectors as mentioned are found in PCT/IB2009/054333 and PCT/IB2009/054334, both in the name of the Applicant.

The airflow which needs to be compensated can be calculated, using the following equation:

$$\Phi_c=\pi*f*W*F*(D*I-I^2)$$

in which:

$\Phi_c$=airflow which needs to be compensated for ($m^3/s$)
f=brush frequency (Hz)
W=width of the brush 12 (m)
F=brush compensation factor (-)
D=diameter of the brush 12 (m)
I=indentation of the brush 12 by the surface 20 (m)

In a practical example, f=133 Hz, W=0.25 m, D=0.044 m, and I=0.003 m. In respect of the brush compensation factor, it is noted that this factor is determined on the basis of experiments with a brush having features as mentioned above, and is found to be 0.4. With the values as mentioned, the following compensation flow is found:

$$\Phi_c=\pi*133*0.25*0.4*(0.044*0.003-0.003^2)$$
$$=0.005015\ m^3/s$$

Hence, in this example, it is advantageous to have a compensating airflow of about 5 liters per second. Such an airflow can very well be realized in practice with one of the implementation possibilities exemplarily mentioned above, so that the disadvantageous pumping effect of the brush 12 can actually be dispensed with.

Figure 9:
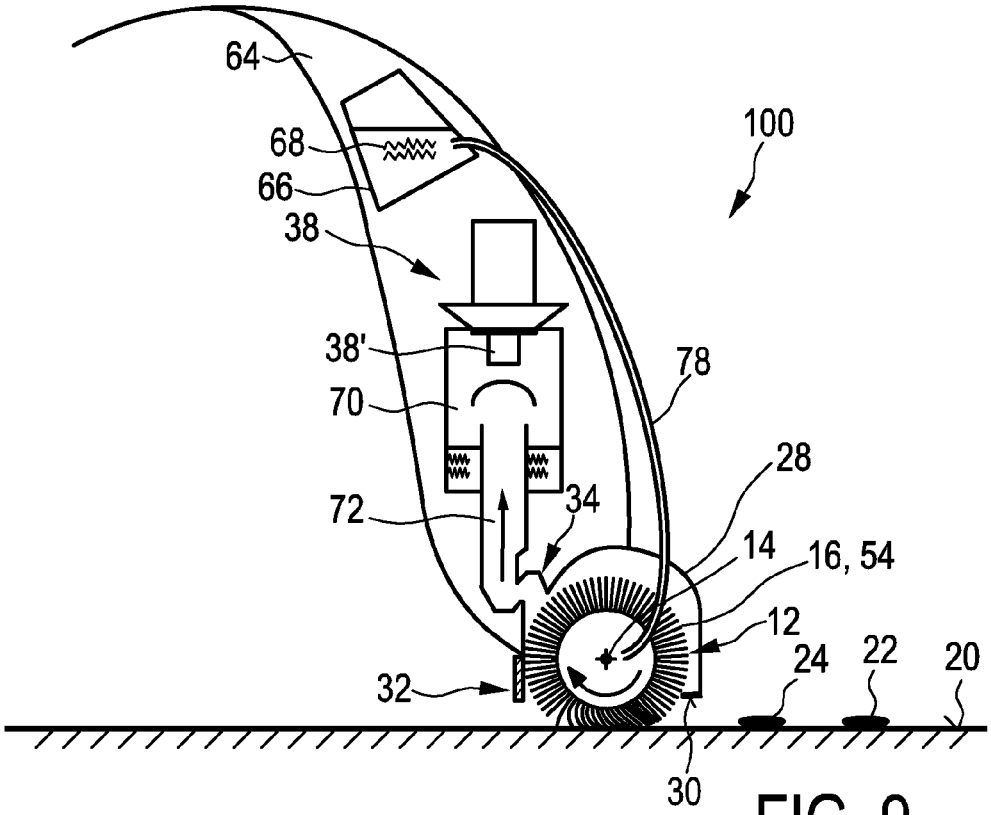
FIG. 9 shows a schematic cross-section of the cleaning device according to the present invention in its entirety.

FIG. 9 provides a view of the cleaning device 100 according to the present invention in its entirety. According to this schematic arrangement the cleaning device 100 comprises a nozzle housing 28 in which the brush 12 is rotatably mounted on the brush axis 14. A drive means, which can be realized by a regular motor, such as e.g. an electro motor (not shown), is preferably connected to or even located on the brush axis 14 for the purpose of driving the brush 12 in rotation. It is noted that the motor may also be located at any other suitable position within the cleaning device 100.

In the nozzle housing 28 wheels (not shown) are arranged for keeping the rotation axis 14 of the brush 12 at a predetermined distance from the surface 20 to be cleaned, wherein the distance is chosen such that the brush 12 is indented. Preferably, the range of the indentation is from 2% to 12% of a diameter of the brush 12 relating to a fully outstretched condition of the brush elements 16. Hence, when the diameter is in an order of 50 mm, the range of the indentation can be from 1 to 6 mm.

Besides the nozzle housing 28, the brush 12 and the first deflector element 32, the cleaning device 100 is preferably provided with the following components:

a handle 64 which allows for easy manipulation of the cleaning device 100 by a user;

a reservoir 66 for containing a cleansing liquid 68 such as water;

a debris collecting container 70 (also denoted as dust pan) for receiving liquid 24 and dirt particles 22 picked up from the surface 20 to be cleaned;

the exhaust channel 72 (e.g. a hollow tube) connecting the debris collecting container 70 to the interior of the nozzle housing 28; and the vacuum fan aggregate 38 (not mandatory) arranged at a side of the debris collecting chamber 70 which is opposite to the side where the exhaust channel 72 is arranged.

For sake of completeness, it is noted that within the scope of the present invention, other and/or additional constructional details are possible. Also, the optional vacuum fan aggregate 38 may be arranged at another side of the debris collecting chamber 70 than the side which is opposite to the side where the exhaust channel 72 is arranged.

Figure 10:
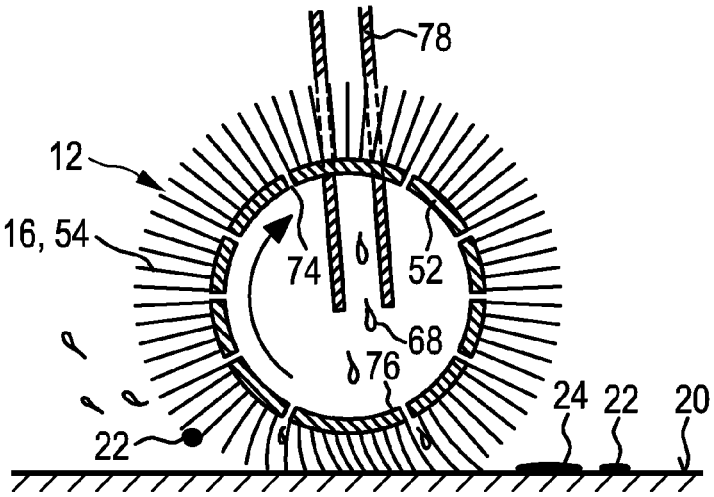
FIG. 10 shows a schematic cross-section of a further embodiment of the brush of the cleaning device.

According to an embodiment, which is shown in FIG. 10, the brush 12 comprises a core element 52. This core element 52 is in the form of a hollow tube provided with a number of channels 74 extending through a wall 76 of the core element 52. For the purpose of transporting cleansing fluid 68 from the reservoir 66 to the inside of the hollow core element 52 of the brush 12, e.g. a flexible tube 78 may be provided that leads into the inside of the core element 52.

According to this embodiment cleansing fluid 68 may be supplied to the hollow core element 52, wherein, during the rotation of the brush 12, the liquid 68 leaves the hollow core element 52 via the channels 74 and wets the brush elements 16. In this way the liquid 68 also drizzles or falls on the surface 20 to be cleaned. Thus, the surface 20 to be cleaned becomes wet with the cleansing liquid 68. This especially enhances the adherence of the dirt particles 22 to the brush elements 16 and therefore improves the ability to remove stains from the surface 20 to be cleaned.

According to the present invention, the rate at which the liquid 68 is supplied to the hollow core element 52 can be quite low, wherein a maximum rate can be 6 ml per minute per cm of the width of the brush 12.

However, it is to be noted that the feature of actively supplying water 68 to the surface 20 to be cleaned using hollow channels 74 within the brush 12 is not a necessary, but an optional feature. Alternatively, a cleansing liquid could be supplied by spraying the brush 12 from outside or by simply immersing the brush 12 in cleansing water before the use. Instead of using an intentionally chosen liquid it is also possible to use a liquid that has been already spilled, i.e. a liquid that needs to be removed from the surface 20 to be cleaned.

The pick-up of the cleansing water 68 from the floor is done as already mentioned above. In comparison with conventional devices comprising hard brushes that are not able to pick-up water, the brush 12 that may be used according to the present invention is capable of picking-up water. The realized cleaning results are thus significantly better.

The technical parameters regarding the brush 12, the brush elements 16 and the drive means result from experiments which have been performed in the context of the present invention.

In the following, one of the experiments and the results of the experiment will be described. The tested brushes were equipped with different types of fiber materials used for the brush elements 16, including relatively thick fibers and relatively thin fibers. Furthermore, the packing density as well as the Dtex values have been varied. The particulars of the various brushes are given in the following table.

| | packing density (# tufts/ $cm^2$) | fibers per tuft | Dtex value (g/10 km) | fiber material | fiber length (mm) | fiber appearance |
|---|---|---|---|---|---|---|
| brush 1 | 160 | 9 | 113.5 | nylon | 10 | springy, straight |
| brush 2 | 25 | 35 | 31.0 | nylon | 11 | fairly hard, curled |
| brush 3 | 40 | 90 | 16.1 | — | 11 | very soft, twined |
| brush 4 | 50 | 798 | 0.8 | poly-ester | 11 | very soft, twined |

The experiment includes rotating the brush under similar conditions and assessing cleaning results, wear, and power to the surface 20 subjected to treatment with the brush 12. This provides an indication of heat generation on the surface 20. The outcome of the experiment is reflected in the following table, wherein a mark 5 is used for indicating the best results, and lower marks are used for indicating poorer results.

| | stain removal | water pick-up | wear | power to the surface |
|---|---|---|---|---|
| Brush 1 | 5 | 3 | 3 | 3 |
| Brush 2 | 5 | 3 | 1 | 4 |
| Brush 3 | 5 | 4 | 4 | 5 |
| Brush 4 | 5 | 5 | 5 | 5 |

Among other things, the experiment proves that it is possible to have brush elements 16 with a linear mass density in a range of 100 to 150 g per 10 km, and to obtain useful cleaning results, although it appears that the water pick-up, the wear behavior and the power consumption are not so good. It is concluded that an appropriate limit value for the linear mass density is 150 g per 10 km. However, it is clear that with a much lower linear mass density, the cleaning results and all other results are very good. Therefore, it is preferred to apply lower limit values, such as 125 g per 10 km, 50 g per 10 km, 20 g per 10 km, or even 5 g per 10 km. With values in the latter order, it is ensured that cleaning results are excellent, water pick-up is optimal, wear is minimal, and power consumption and heat generation on the surface 20 are sufficiently low.

It is noted that the optional minimum value of 3,000 $m/s^2$ in respect of the acceleration which is prevailing at tips 18 of the brush elements 16 during some time per revolution of the brush 12, in particular some time during a dirt release period, in which there is no contact between the brush elements 16 and the surface 20, is supported by results of experiments which have been performed in the context of the present invention.

In the following, one of the experiments and the results of the experiment will be described. The following conditions are applicable to the experiment:

1) A brush 12 having a diameter of 46 mm, a width of approximately 12 cm, and polyester brush elements 16 with a linear mass density of about 0.8 g per 10 km, arranged in tufts 54 of about 800 brush elements 16, with approximately 50 tufts 54 per $cm^2$, is mounted on a motor shaft.
2) The weight of the assembly of the brush 12 and the motor is determined.
3) The power supply of the motor is connected to a timer for stopping the motor after a period of operation of 1 second or a period of operation of 4 seconds.

4) The brush 12 is immersed in water, so that the brush 12 is completely saturated with the water. It is noted that the brush 12 which is used appears to be capable of absorbing a total weight of water of approximately 70 g.
5) The brush 12 is rotated at an angular velocity of 1,950 revolutions per minute, and is stopped after 1 second or 4 seconds.
6) The weight of the assembly of the brush 12 and the motor is determined, and the difference with respect to the dry weight, which is determined under step 2), is calculated.
7) Steps 4) to 6) are repeated for other values of the angular velocity, in particular the values as indicated in the following table, which further contains values of the weight of the water still present in the brush 12 at the stops after 1 second and 4 seconds, and values of the associated centrifugal acceleration, which can be calculated according to the following equation:

$$a=(2*\pi*f)^2*R$$

in which:
a=centrifugal acceleration ($m/s^2$)
f=brush frequency (Hz)
R=radius of the brush 12 (m)

| angular velocity (rpm) | weight of water present after 1 s (g) | weight of water present after 4 s (g) | centrifugal acceleration ($m/s^2$) |
|---|---|---|---|
| 1,950 | 8.27 | 7.50 | 959 |
| 2,480 | 5.70 | 4.57 | 1,551 |
| 3,080 | 3.70 | 3.11 | 2,393 |
| 4,280 | 2.52 | 1.97 | 4,620 |
| 5,540 | 1.95 | 1.35 | 7,741 |
| 6,830 | 1.72 | 1.14 | 11,765 |
| 7,910 | 1.48 | 1.00 | 15,780 |
| 9,140 | 1.34 | 0.94 | 21,069 |

Figure 11:
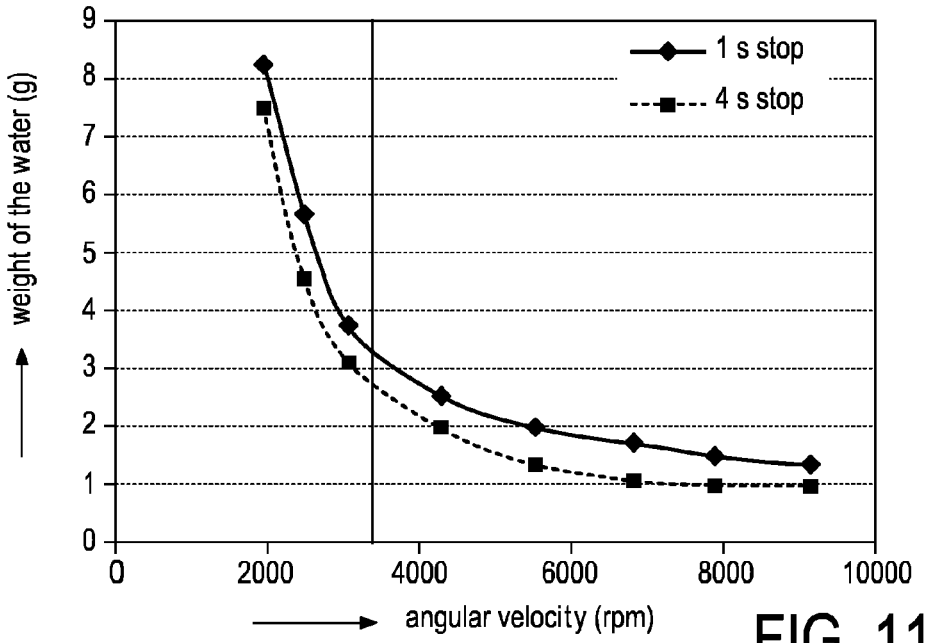
FIG. 11 shows a graph which serves for illustrating a relation between an angular velocity of a brush and a self-cleaning capacity of said brush.
Figure 12:
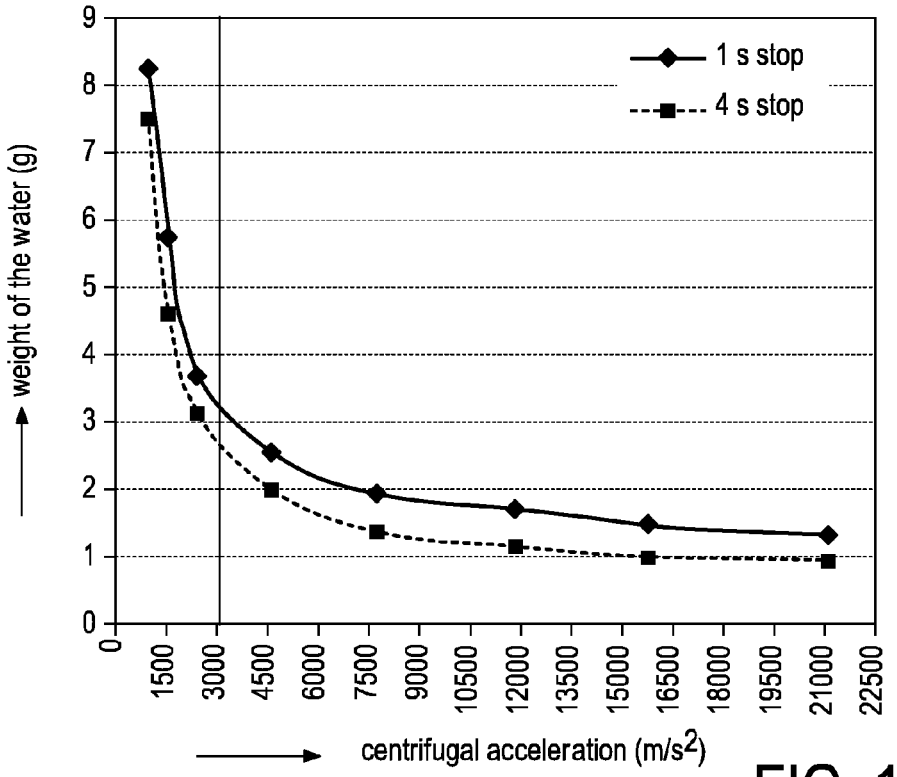
FIG. 12 shows a graph which serves for illustrating a relation between a centrifugal acceleration of a brush and a self-cleaning capacity of said brush.

The relation which is found between the angular velocity and the weight of the water for the two different stops is depicted in the graph of FIG. 11, and the relation which is found between the centrifugal acceleration and the weight of the water for the two different stops is depicted in the graph of FIG. 12, wherein the weight of the water is indicated at the vertical axis of each of the graphs. It appears from the graph of FIG. 11 that the release of water by the brush 12 strongly decreases, when the angular velocity is lower than about 4,000 rpm. Also, it seems to be rather stable at angular velocities which are higher than 6,000 rpm to 7,000 rpm.

A transition in the release of water by the brush 12 can be found at an angular velocity of 3,500 rpm, which corresponds to a centrifugal acceleration of 3,090 $m/s^2$. For sake of illustration of this fact, the graphs of FIGS. 11 and 12 contain a vertical line indicating the values of 3,500 rpm and 3,090 $m/s^2$, respectively.

On the basis of the results of the experiment as explained in the foregoing, it may be concluded that a value of 3,000 $m/s^2$ in respect of an acceleration at tips 18 of the brush elements 16 during a contact-free period is a realistic minimum value as far as the self-cleaning capacity of brush elements 16 which meet the optional requirement of having a linear mass density which is lower than 150 g per 10 km, at least at tip portions 18, is concerned. A proper performance of the self-cleaning function is important for obtaining good cleaning results, as has already been explained in the foregoing.

For sake of completeness, it is noted that in the cleaning device 100 according to the present invention, the centrifugal acceleration may also be lower than 3,000 $m/s^2$. The reason is that the acceleration which occurs at tips 18 of the brush elements 16 when the brush elements 16 are straightened out can be expected to be higher than the normal centrifugal acceleration. The experiment shows that a minimum value of 3,000 $m/s^2$ is valid in respect of an acceleration, which is the normal, centrifugal acceleration in the case of the experiment, and which can be the higher acceleration which is caused by the specific behavior of the brush elements 16 when the dirt pick-up period has passed and there is room for straightening out in an actual cleaning device 100 according to the present invention, which leaves a possibility for the normal, centrifugal acceleration during the other periods of the rotation (e.g. the dirt pick-up period) to be lower.

Even though a single brush is according to the present invention preferred, it is clear that also further brushes may be used without leaving the scope of the present invention. Further, it is to be noted that the above-mentioned brush parameters are only optional parameters that may be used to further increase the cleaning effect.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the figures and the description, such illustration and description are to be considered illustrative or exemplary only, and not restrictive. The present invention is not limited to the disclosed embodiments.

For sake of clarity, it is noted that a fully outstretched condition of the brush elements 16 is a condition in which the brush elements 16 are fully extending in a radial direction with respect to a rotation axis 14 of the brush 12, wherein there is no bent tip portion in the brush elements 16. This condition can be realized when the brush 12 is rotating at a normal operative speed, which may be a speed at which an acceleration of 3,000 $m/s^2$ at the tips 18 of the brush elements 16 can be realized. It is possible for only a portion of the brush elements 16 of a brush 12 to be in the fully outstretched condition, while another portion is not, due to obstructions which are encountered by the brush elements 16. Normally, the diameter D of the brush 12 is determined with all of the brush elements 16 in the fully outstretched condition.

The tip portions 18 of the brush elements 16 are outer portions of the brush elements 16 as seen in the radial direction, i.e. portions which are the most remote from the rotation axis 14. In particular, the tip portions 18 are the portions which are used for picking up dirt particles 22 and liquid, and which are made to slide along the surface 20 to be cleaned. In case the brush 12 is indented with respect to the surface 20, a length of the tip portion is approximately the same as the indentation.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

The invention claimed is:

1. A nozzle arrangement for a vacuum cleaning device, the nozzle arrangement having a substantially planar bottom surface and comprising:

a brush rotatable about a brush axis, said brush being provided with brush elements having tip portions for contacting a surface to be cleaned and picking up dirt and/or liquid particles from the surface during the rotation of the brush, a drive means for rotating the brush, a first deflector element with a first deflector surface that extends substantially parallel to the brush axis, wherein the first deflector surface is configured to engage with the brush during the rotation of the brush for releasing the picked-up dirt and/or the liquid particles from the brush, a second deflector element that is spaced apart from the brush and the first deflector element continuously providing a gap between the second deflector element and the brush during use, and an exhaust channel that begins between the first and second deflector elements and extends in a first direction away from the second deflector element and thereafter extends in a second direction away from the first deflector element, the second deflector element comprising a second deflector surface that is one of planar or is a curved surface that curves towards the exhaust channel, wherein the second deflector element comprises at least one further deflector surface arranged adjacent to the second deflector surface, the second deflector surface, while being spaced apart from the first deflector surface, has a surface that is oriented at an angle to the first deflector surface and each of the at least one further deflector surfaces configured to direct dirt and/or liquid particles, which are released from the brush at the first deflector surface at a release angle with regard to the first deflector surface directed towards the second deflector surface, to be subsequently deflected by the second deflector surface towards at least one further deflector surface prior to being deflected by the at least one further deflector surface into the exhaust channel, wherein the second deflector surface faces the first direction of the exhaust channel, wherein, when the nozzle is operated during a cleaning process with the bottom surface of the nozzle arrangement oriented substantially parallel to a surface being cleaned, the first deflector surface is arranged perpendicular to the surface to be cleaned, and wherein the at least one further deflector surface is either planar or is curved and connected to the second deflector surface by an increased curvature portion to at least partially face the second deflector surface.

2. The nozzle arrangement as claimed in claim 1, wherein the first deflector surface contacts the tip portions of the brush during the rotation of the brush for releasing the picked-up dirt and/or the liquid particles from the brush.

3. The nozzle arrangement as claimed in claim 1, wherein the second deflector surface has a tilted orientation relative to the first deflector surface, and wherein a tilt angle y between the second deflector surface and a normal vector of the first deflector surface, is in a range of $10° < \gamma < 40°$.

4. The nozzle arrangement as claimed in claim 1, comprising a container having a bottom side that is substantially parallel to the surface to be cleaned during the cleaning process.

5. The nozzle arrangement as claimed in claim 1, wherein the second deflector element comprises curved surfaces that face into the exhaust channel and are configured to guide the dirt and/or liquid particles that are released from the brush at the first deflector surface into the exhaust channel.

6. The nozzle arrangement as claimed in claim 1, wherein, when the further deflector surface is planar, the at least one further deflector surface comprises a third deflector surface arranged adjacent to the second deflector surface and a fourth deflector surface arranged adjacent to the third deflector surface, wherein the third deflector surface is arranged at an angle to the second deflector surface, and wherein the fourth deflector surface is arranged at an angle to the second and the third deflector surface.

7. The nozzle arrangement as claimed in claim 6, wherein the second, the third and the fourth deflector surfaces together form an arched guiding configuration that faces into the exhaust channel and is configured to guide the dirt and/or liquid particles into the exhaust channel by deflecting them at the second and/or the third and/or the fourth deflector surface.

8. The nozzle arrangement as claimed in claim 1, further comprising an adjustment mechanism that is configured to adjust the position of at least a portion of the first deflector element relative to the surface to be cleaned depending on a direction of movement of the device, wherein the first deflector element is provided in a first position in which the portion of the first deflector element has a first distance d1 to the surface to be cleaned when the vacuum cleaning device is moved in a forward direction, in which the first deflector element is, seen in the direction of movement of the device, located behind the brush, and the adjustment mechanism is configured to position the portion of the first deflector element in a second position in which the portion of the first deflector element has a second distance d2 to the surface to be cleaned, when the vacuum cleaning device is moved in an opposite backward direction, wherein the second distance d2 is larger than the first distance d1.

9. The nozzle arrangement as claimed in claim 1, wherein a linear mass density of a plurality of the brush elements is, at least at the tip portions, lower than 150 g per 10 km.

10. The nozzle arrangement as claimed in claim 1, wherein the drive means are adapted to realize an angular velocity of the brush which is in a range of 3,000 to 15,000 revolutions per minute, during operation of the vacuum cleaning device.

11. The nozzle arrangement as claimed in claim 1, wherein the first deflector element is part of a squeegee that comprises a flexible rubber lip.

12. A vacuum cleaning device for cleaning a surface, comprising a nozzle arrangement having a substantially planar bottom surface and comprising:

a brush rotatable about a brush axis, said brush being provided with brush elements having tip portions for contacting a surface to be cleaned and picking up dirt and/or liquid particles from the surface during the rotation of the brush, a drive means for rotating the brush, a first deflector element with a first deflector surface that extends substantially parallel to the brush axis, wherein the first deflector surface is configured to engage with the brush during the rotation of the brush for releasing the picked-up dirt and/or the liquid particles from the brush, a second deflector element that is spaced apart from the brush and the first deflector element continuously providing a gap between the second deflector element and the brush during use, and an exhaust channel that begins between the first and second deflector elements and extends in a first direction away from the second deflector element and thereafter extends in a second direction away from the first deflector element, the second deflector element comprising a second deflector surface that is one of planar or is a curved surface that curves towards the exhaust channel, wherein the second deflector element comprises at least one further deflector surface arranged adjacent to the second deflector surface, the second deflector surface, while being spaced apart from the first deflector surface, has a surface that is oriented at an angle to the first deflector surface and each of the at least one further deflector surfaces configured to direct dirt and/or liquid particles, which are released from the brush at the first deflector surface at a release angle with regard to the first deflector surface directed towards the second deflector surface, to be subsequently deflected by the second deflector surface towards at least one further deflector surface prior to being deflected by the at least one further deflector surface into the exhaust channel, wherein the second deflector surface faces the first direction of the exhaust channel wherein, when the nozzle is operated during a cleaning process with the bottom surface of the nozzle arrangement oriented substantially parallel to a surface being cleaned, the first deflector surface is arranged perpendicular to the surface to be cleaned, and wherein the at least one further deflector surface is either planar or is curved and connected to the second deflector surface by an increased curvature portion to at least partially face the second deflector surface.

13. The vacuum cleaning device as claimed in claim 12, further comprising a vacuum aggregate for generating an under-pressure within the exhaust channel for ingesting the dirt and/or liquid particles, wherein said under-pressure generated by the vacuum aggregate is in a range of 3 to 70 mbar.

* * * * *